US007243064B2

(12) United States Patent
Paris

(10) Patent No.: US 7,243,064 B2
(45) Date of Patent: Jul. 10, 2007

(54) SIGNAL PROCESSING OF MULTI-CHANNEL DATA

(75) Inventor: Alan T. Paris, Jackson, MS (US)

(73) Assignee: Verizon Business Global LLC, Basking Ridge, NJ (US)

( * ) Notice: Subject to any disclaimer, the term of this patent is extended or adjusted under 35 U.S.C. 154(b) by 892 days.

(21) Appl. No.: 10/293,596

(22) Filed: Nov. 14, 2002

(65) Prior Publication Data

US 2004/0101048 A1 May 27, 2004

(51) Int. Cl.
*G10L 21/00* (2006.01)

(52) U.S. Cl. ..... 704/219; 375/265

(58) Field of Classification Search ..... 704/219; 375/265

See application file for complete search history.

(56) References Cited

U.S. PATENT DOCUMENTS 4,980,897 A * 12/1990 Decker et al. ..... 375/265
6,553,121 B1 * 4/2003 Matsuo et al. ..... 381/17
6,675,148 B2 * 1/2004 Hardwick ..... 704/500
6,678,652 B2 * 1/2004 Fuchigami et al. ..... 704/219

* cited by examiner

*Primary Examiner*—Daniel Abebe

(57) ABSTRACT

An approach for providing non-commutative approaches to signal processing. Quaternions are used to represent multi-dimensional data (e.g., three- and four-dimensional data). Additionally, a linear predictive coding scheme (e.g., based on the Levinson algorithm) that can be applied to wide class of signals in which the autocorrelation matrices are not invertible and in which the underlying arithmetic is not commutative. That is, the linear predictive coding scheme multi-channel can handle singular autocorrelations, both in the commutative and non-commutative cases. This approach also utilizes random path modules to replace the statistical basis of linear prediction.

23 Claims, 6 Drawing Sheets

SIGNAL PROCESSING OF MULTI-CHANNEL DATA

FIELD OF THE INVENTION

The present invention relates to signal processing, and is more particularly related to linear prediction.

BACKGROUND OF THE INVENTION

Signals can represent information from any source that generates data, relating to electromagnetic energy to stock prices. Analysis of these signals is the focus of signal processing theory and practice. Linear prediction is an important signal processing technique that provides a number of capabilities: (1) prediction of the future of a signal from its past; (2) extraction of important features of a signal; and (3) compression of signals. The economic value of linear prediction is incalculable as its prevalence in industry is enormous.

It is observed that many important signals are "multi-channel" in that the signals are gathered from many independent sources; e.g., time series. For example, multi-channel data stem from the process of searching for oil, which requires measuring the earth at many locations simultaneously. Also, measuring the motions of walking (i.e., gait) requires simultaneously capturing the positions of many joints. Further, in a video system, a video signal is a recording of the color of every pixel on the screen at the same moment; essentially each pixel is essentially a separate "channel" of information. Linear prediction can be applied to all of the above disparate applications.

Conventional linear prediction techniques have been inadequate in the treatment of multi-channel time series, particularly, when the dimensionality is in the order is above three. There are traditional approaches of linear prediction for multi-channel signals, but are not effective in addressing the technical difficulties that are caused by the interactions of the sources of data. In single source signals, such as like voice, these difficulties are not encountered. The conventional techniques assume that the autocorrelation matrix of the data is invertible or can be made invertible by simple methods, which is rarely valid for real multi-channel data.

Also, such traditional approaches do not use the structural information available through modeling multi-dimensional geometry in a more sophisticated manner than merely as arrays of numbers. In addition, these approaches fail to take into account the phenomenon of time warping, which, for example, is critical to successful modeling of biometric time series. Further, conventional linear prediction techniques are based on a statistical foundation for linear prediction, which is not well suited for motion, video and other types of multi-channel data.

Further, it is recognized that most real multi-channel data are highly correlated. Under the conventional approaches, the popular linear prediction algorithm, known as the Levinson algorithm, cannot be applied to highly correlated channels.

Therefore, there is a need to provide a framework for extending applicability of linear prediction techniques. Additionally, there is a need for an approach to predict/compress/encrypt multi-channel multi-dimensional time series, particularly series with high correlation.

SUMMARY OF THE INVENTION

These and other needs are addressed by the present invention in which non-commutative approaches to signal processing are provided. In one embodiment, quaternions are used to represent multi-dimensional data (e.g., three- and four-dimensional data, etc.). Additionally, an embodiment of the present invention provides a linear predictive coding scheme (e.g., based on the Levinson algorithm) that can be applied to a wide class of signals in which the autocorrelation matrices are not invertible and in which the underlying arithmetic is not commutative. That is, the linear predictive coding scheme can handle singular autocorrelations, both in the commutative and non-commutative cases. Random path modules are utilized to replace the statistical basis of linear prediction. The present invention, according to one embodiment, advantageously provides an effective approach for linearly predicting multi-channel data that is highly correlated. The approach also has the advantage of solving the problem of time-warping.

In one aspect of the present invention, a method for providing linear prediction is disclosed. The method includes collecting multi-channel data from a plurality of independent sources, and representing the multi-channel data as vectors of quaternions. The method also includes generating an autocorrelation matrix corresponding to the quaternions. The method further includes outputting linear prediction coefficients based upon the autocorrelation matrix, wherein the linear prediction coefficients represent a compression of the collected multi-channel data.

In another aspect of the present invention, a method for supporting video compression is disclosed. The method includes collecting time series video signals as multi-channel data, wherein the multi-channel data is represented as vectors of quaternions. The method also includes generating an autocorrelation matrix corresponding to the quaternions, and outputting linear prediction coefficients based upon the autocorrelation matrix.

In another aspect of the present invention, a method of signal processing is provided. The method includes receiving multi-channel data, representing multi-channel data as vectors of quaternions, and performing linear prediction based on the quaternions.

In another aspect of the present invention, a method of performing linear prediction is provided. The method includes representing multi-channel data as a pseudo-invertible matrix, generating a pseudo-inverse of the matrix, and outputting a plurality of linear prediction weight values and associated residual values based on the generating step.

In another aspect of the present invention, a computer-readable medium carrying one or more sequences of one or more instructions for performing signal processing is disclosed. The one or more sequences of one or more instructions include instructions which, when executed by one or more processors, cause the one or more processors to perform the steps of receiving multi-channel data, representing multi-channel data as vectors of quaternions, and performing linear prediction based on the quaternions.

In yet another aspect of the present invention, a computer-readable medium carrying one or more sequences of one or more instructions for performing signal processing is disclosed. The one or more sequences of one or more instructions include instructions which, when executed by one or more processors, cause the one or more processors to perform the steps of representing multi-channel data as a pseudo-invertible matrix, generating a pseudo-inverse of the matrix, and outputting a plurality of linear prediction weight values and associated residual values based on the generating step.

Still other aspects, features, and advantages of the present invention are readily apparent from the following detailed description, simply by illustrating a number of particular embodiments and implementations, including the best mode contemplated for carrying out the present invention. The present invention is also capable of other and different embodiments, and its several details can be modified in various obvious respects, all without departing from the spirit and scope of the present invention. Accordingly, the drawing and description are to be regarded as illustrative in nature, and not as restrictive.

BRIEF DESCRIPTION OF THE DRAWINGS

The present invention is illustrated by way of example, and not by way of limitation, in the figures of the accompanying drawings and in which like reference numerals refer to similar elements and in which.

DESCRIPTION OF THE PREFERRED EMBODIMENT

A system, method, and software for processing multi-channel data by non-commutative linear prediction are described. In the following description, for the purposes of explanation, numerous specific details are set forth in order to provide a thorough understanding of the present invention. It is apparent, however, to one skilled in the art that the present invention may be practiced without these specific details or with an equivalent arrangement. In other instances, well-known structures and devices are shown in block diagram form in order to avoid unnecessarily obscuring the present invention.

The present invention has applicability to a wide range of fields in which multi-channel data exist, including, for example, virtual reality, doppler radar, voice analysis, geophysics, mechanical vibration analysis, materials science, robotics, locomotion, biometrics, surveillance, detection, discrimination, tracking, video, optical design, and heart modeling.

Figure 1:
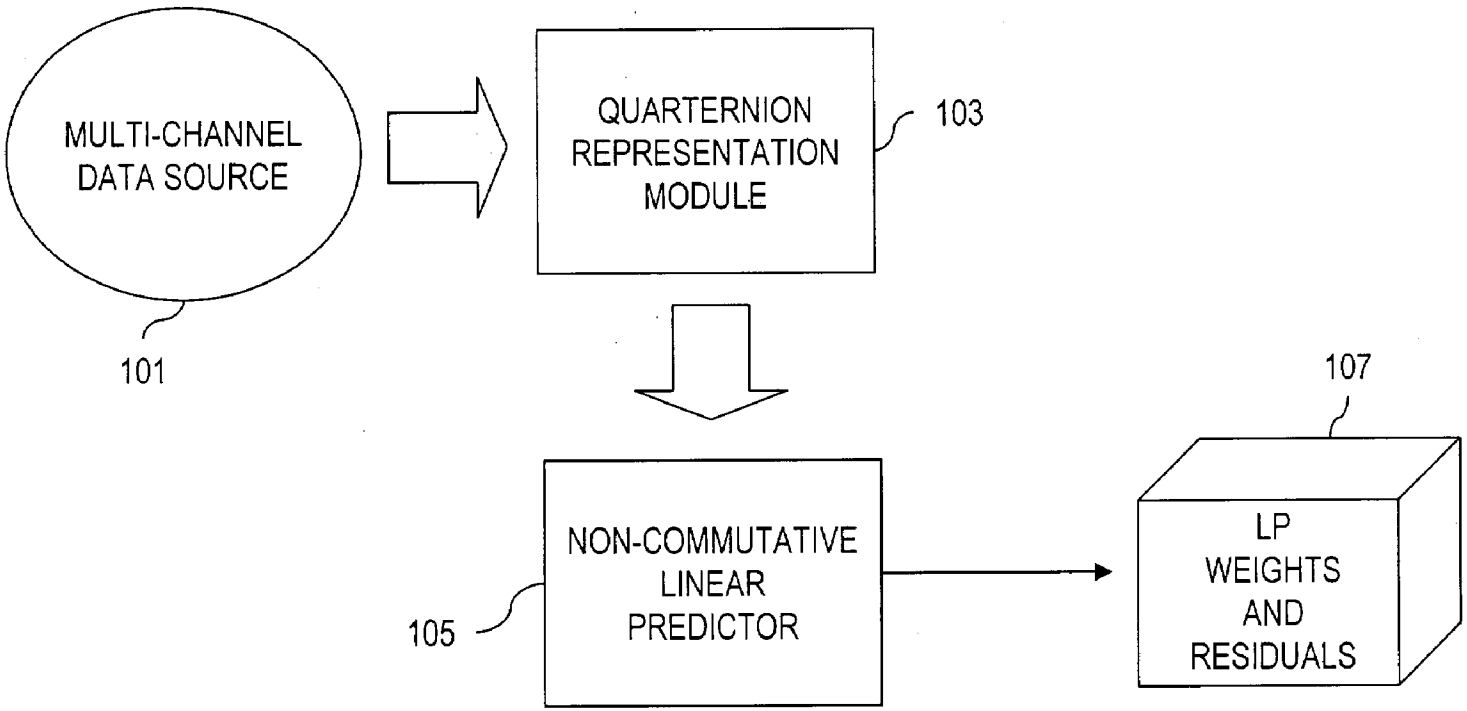
FIG. 1 is a diagram of a system for providing non-commutative linear prediction, according to an embodiment of the present invention.

FIG. 1 is a diagram of a system for providing linear prediction, according to an embodiment of the present invention. As shown in FIG. 1, a multi-channel data source 101 provides data that is converted to quaternions by a data representation module 103. Quaternions have not been employed in signal processing, as conventional linear prediction techniques cannot process quaternions in that these techniques employ the concept of numbers, not points. According to one embodiment of the present invention, quaternions can be parsed into a rotational part and a scaling part; this construct, for example, can correct time warping, as will be more fully described below.

These quaternions are then supplied to a non-commutative linear predictor 105, which generates the linear prediction matrix 107 of weights and associated residuals. The linear predictor 105, in an exemplary embodiment, provides a generalization of the Levinson algorithm to process non-invertible autocorrelation matrices over any ring that admits compact projections. Linear predictive techniques conventionally have been presented in a statistical context, which excludes the majority of multi-channel data sources to which the linear predictor 105 is targeted.

The signal processing of spatial time series has been traditionally limited by the lack of a sophisticated link between the signal processing algebra and the spatial geometry. The ordinary algebra of the real or complex numbers satisfies the commutative law a×b=b×a and the law of inverses: for every non-zero number a there is a number $$\frac{1}{a}$$

for which $$a\times\left(\frac{1}{a}\right)=\left(\frac{1}{a}\right)\times a=1.$$

However, these properties fail for the quaternions and for three-dimensional multi-channel signal processing. The theories of hermitian regular rings and compact projections allow important signal processing techniques to be utilized in such situations.

One of the major application areas of the invention is to video image processing. To enable this application, color data needs to be correctly represented as four-dimensional spatial points. Photopic coordinates are four-dimensional analogs of the common RGB (Red-Green-Blue) colormetric coordinates.

Also, in gait analysis, for example, each joint reports where it currently is located. In the oil exploration example, each of many sensors spread over the area that is being searched sends back information about where the surface on which it is sitting is located after the geologist has set off a nearby explosion. The cardiology example requires knowing, for many structures inside and around the heart, how these structures move as the heart beats.

Even the video example can be seen that way because each pixel on the screen is reporting its color at every moment of time. However, a "color" is not a simple number: it is actually (at least) 3 numbers such as the amount of red, blue, and green (RGB) light needed to make that color. Those three numbers are usually thought of as being in a "color space" which is a kind of abstract space like three-dimensional space.

As mentioned, the present invention, according to one embodiment, represents each such point in space by a mathematical object called a "quaternion." Quaternions can describe special information, such as rotations, perspective drawing, and other simple concepts of geometry. If a signal, such as the position of a joint during a walk is described using quaternions, it reveals structure in the signal that is hidden such as how the rotation of the knee is related to the rotation of the ankle as the walk proceeds.

Figure 2A:
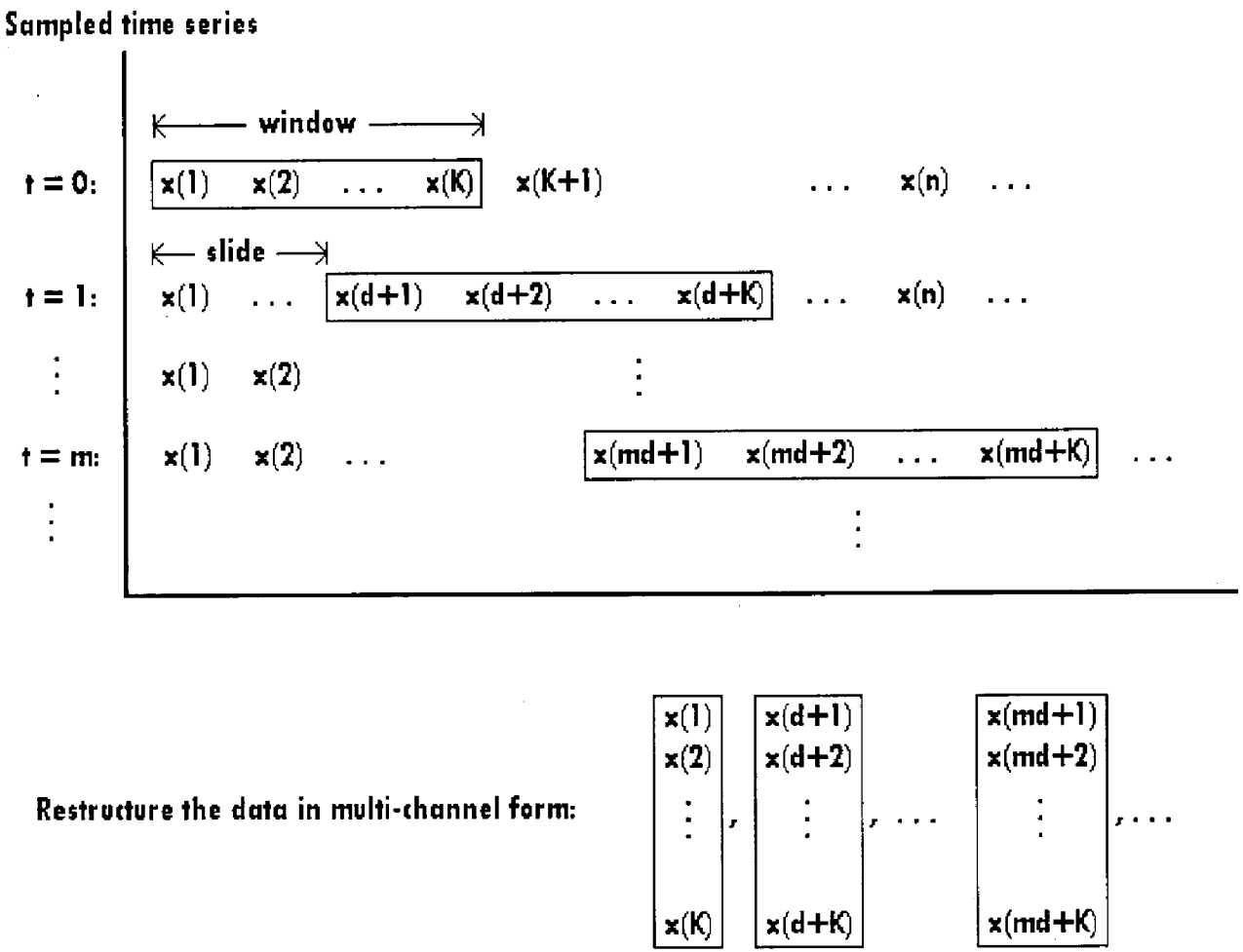
FIGS. 2A and 2B are diagrams of multi-channel data capable of being processed by the system of FIG. 1.
Figure 2B:
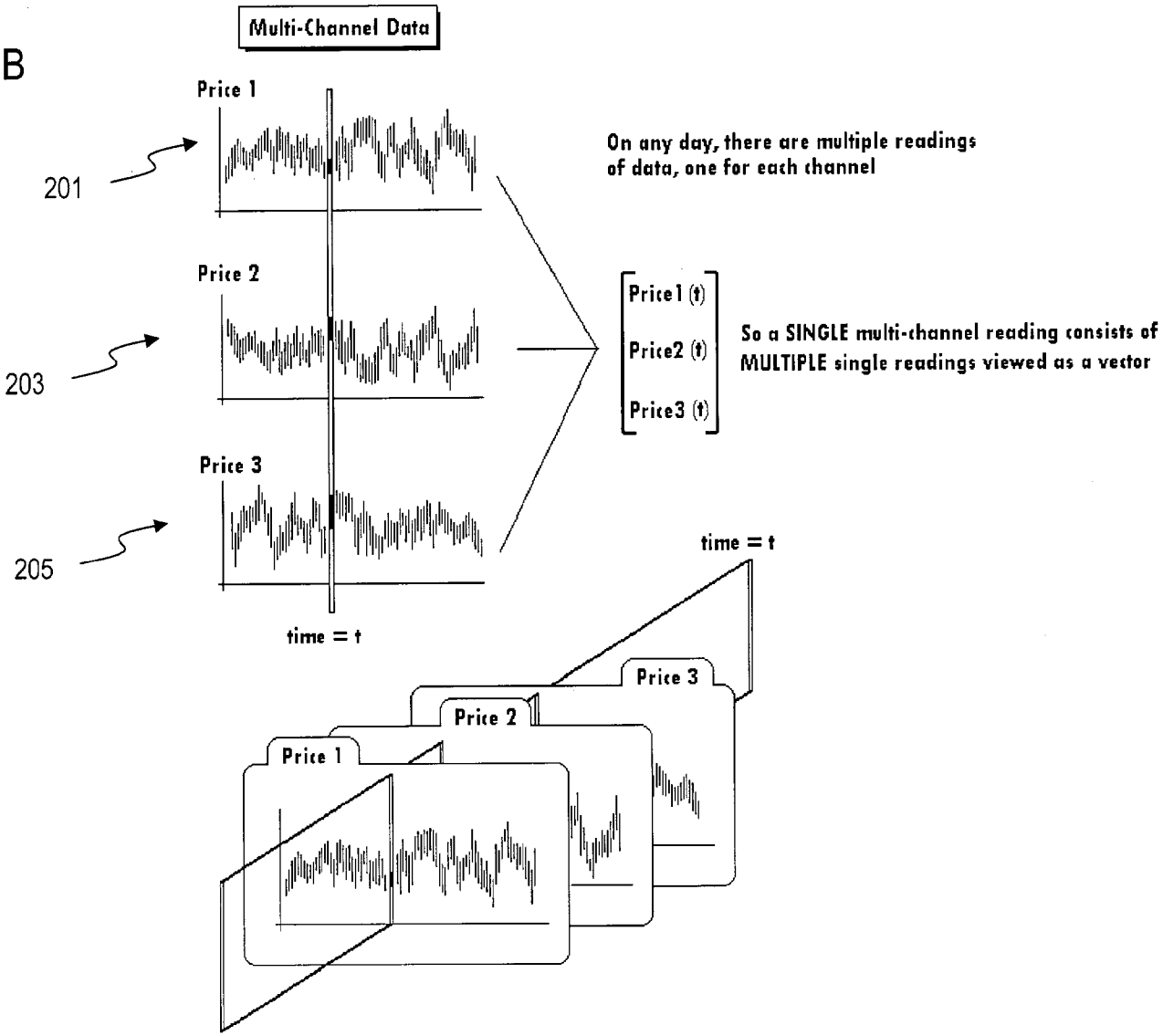

FIGS. 2A and 2B are diagrams of multi-channel data capable of being processed by the system of FIG. 1. As shown in FIG. 2A, many practical datasets comprise time series . . . $x_{n-2}$, $x_{n-1}$, $x_n$ of data vectors where, at each time n, the datum $x_n$ is a vector $$x_n = \begin{pmatrix} x_n(1) \\ x_n(2) \\ \vdots \\ x_n(K) \end{pmatrix}$$

of three-dimensional measurements. Each component $x_n(k)$ represents the measurement of a single channel and is itself composed of three separate real numbers $x_n(k)=(x_n(k)^1 x_n(k)^2 x_n(k)^3)$ corresponding to the three dimensions of whatever system that is being measured.

It is clear that cross-channel measurements can be represented as a list, $x_n$:

$$x_n = \left( \begin{pmatrix} x_n(1)^1 \\ x_n(2)^1 \\ \vdots \\ x_n(K)^1 \end{pmatrix} \begin{pmatrix} x_n(1)^2 \\ x_n(2)^2 \\ \vdots \\ x_n(K)^2 \end{pmatrix} \begin{pmatrix} x_n(1)^3 \\ x_n(2)^3 \\ \vdots \\ x_n(K)^3 \end{pmatrix} \right),$$

such as the RGB bitplanes of video and, in fact, this is usually how three-dimensional datasets are generated. However, the former representation is conceptually more basic.

As seen in FIG. 2B, a time series relating to the prices of stocks, for example, exist, and can be viewed as a single multi-channel data. In this example, three sources 201, 203, 205 can be constructed as a single vector based on time, t.

According to one embodiment of the present invention, multi-channel can be represented as quaternions. Specifically, the present invention provides an approach for analyzing and coding such time series by representing each measurement $x_n(j)$ using the mathematical construction called a quaternion.

Figure 3:
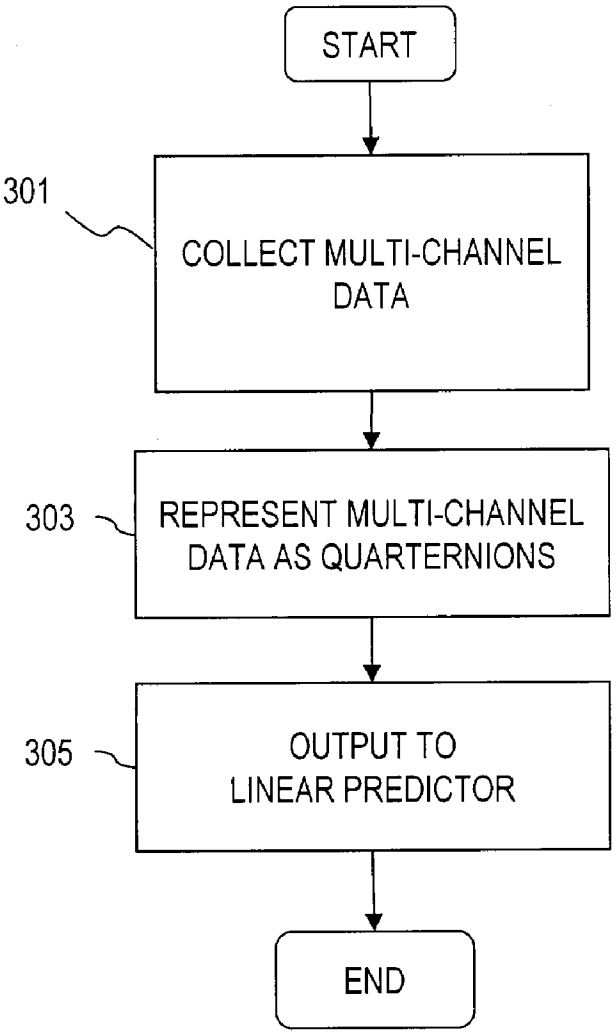
FIG. 3 is a flow chart of a process for representing multi-channel data as quaternions, according to an embodiment of the present invention.

FIG. 3 is a flow chart of a process for representing multi-channel data as quaternions, according to an embodiment of the present invention. In step 301, multi-channel data is collected and then represented as quaternions, as in step 303. These quaternions, per step 305, are then output to a linear predictor (e.g., predictor 105 of FIG. 1).

As used herein, the quaternion algebra is denoted H. Quaternions are four-dimensional generalizations of the complex numbers and may be viewed as a pair of complex numbers (as well as many other representations). Quaternions also have the standard three-dimensional dot- and cross-products built into their algebraic structure along with four-dimensional vector addition, scalar multiplication, and complex arithmetic.

The quaternions have the arithmetical operations of +,−,×, and ÷ for non-0 denominators defined on them and so provide a scalar structure over which vectors, matrices, and the like may be constructed. However, the peculiarity of quaternions is that multiplication is not commutative: in general, $q \times r \neq r \times q$ for quaternions q,r and thus Hforms a division ring, not a field.

The present invention, according to one embodiment, presented herein stems from the observation that many traditional signal processing algorithms, especially those pertaining to linear prediction and linear predictive coding, do not depend on the commutative law holding among the scalars once these algorithms are carefully analyzed to keep track of which side (left or right) scalar multiplication takes place.

As a result, a three- (or four-) dimensional data point can be thought of as a single arithmetical entity rather than a list of numbers. There are great advantages to be gained, both conceptually and practically, by doing so.

As mentioned previously, the application of present invention spans a number of disciplines, from biometrics to virtual reality. For instance, all human control devices from the mouse or gaming joystick up to the most complex virtual reality "suit" are mechanisms for translating spatial motion into numerical time series. One example is a "virtual reality" glove that contains 22 angle-sensitive sensors arrayed on a glove. Position records are sent from the glove to a server at 150 records/sensor/sec at the RS-232 rate of 115.2 kbaud. After conversion to rectangular coordinates, this is precisely a 22-channel time series . . . $x_{n-2}$, $x_{n-1}$, $x_n$, $$x_n = \begin{pmatrix} x_n(1) \\ x_n(2) \\ \vdots \\ x_n(22) \end{pmatrix}$$

of three-dimensional data as discussed above.

The high data rate and sensor sensitivity of the virtual glove is sufficient to characterize hand positions and velocities for ordinary motion. However, the human hand is capable of "extraordinary" motion; e.g., a skilled musician or artisan at work. For example, both pianists and painters have the concept of "touch", an indefinable relation of the hand/finger system to the working material and which, to the trained ear or eye, characterizes the artist as well as a photograph or fingerprint. It is just such subtle motions, which unerringly distinguish human actions from robotic actions.

Even to begin the modeling and reproduction of the true human hand, much higher data rates, much more precise sensors, and much denser sensor array are required. The numbers are comparable, in fact, to the data rates, volume, and density of the nervous system connecting the hand to the brain. At such levels, efficient storing and transmission of such multi-channel data become critical. It is not sufficient to save bandwidth by transmitting only every tenth or hundredth hand position of a pilot landing a jet fighter on the flight deck of a carrier. Instead, the time series need to be globally compressed so that actual redundancy (introduced by inertia and physiological/geometric constraints) but not critical information is removed.

Multi-channel analysis is also utilized in geophysics. Geophysical explorers, like special effects people in cinema, are in the enviable position of being able to set off large explosions in the course of their daily work. This is a basic mode of gathering geophysical data, which arrives from these earth-shaking events (naturally occurring or otherwise) in the form of multi-channel time series recording the response of the earth's surface to the explosions. Each channel represents the measurements of one sensor out of a strategically-designed array of sensors spread over a target area.

While the input data series of any one channel is typically one-dimensional, representing the normal surface strain at a point, the target series is three-dimensional; namely, the displacement vector of each point in a volume. Geophysics is, more than most sciences, concerned with inverse problems: given the boundary response of a mechanical system to a stimulus, determine the response of the three-dimensional internal structure. As oil and other naturally occurring resources become harder to find, it is imperative to improve the three-dimensional signal processing techniques available.

Similar to geophysicists, mechanical engineers examine system response measurements. Typically, a body is covered in a multi-channel network of strain or motion sensors and shakers is attached at selected points. The data usually is transferred to a finite-element model of the system, which is a triangularization of the three-dimensional physical system. Abstractly, these finite-element datasets are nothing more than the multi-channel three-dimensional time series.

Multi-channel analysis also has applicability to biophysics. If a grid is placed over selected points of photographed animals' bodies, and concentrated especially around the joints, time series of multi-channel three-dimensional measurements can be generated from these historical datasets by standard photogrammetric techniques.

The human knee is a complex mechanical system with many degrees of freedom most of which are exercised during even a simple stroll. This applies to an even greater degree to the human spine, with its elegant S-shape, perfectly designed to carry not only the unnatural upright stance of homo sapiens but to act as a complex linear/torsional spring with infinitely many modes of behavior as the body walks, jumps, runs, sleeps, climbs, and, not least of all, reproduces itself. Many well-known neurological diseases, such as multiple sclerosis, can be diagnosed by the trained diagnostician simply by visual observation of the patient's gait.

Paleoanthropologists use computer reconstructions of hominid gaits as a basic tool of their trade, both as an end product of research and a means of dating skeletons by the modernity of the walk they support. Animators are preeminent gait modelers, especially these days when true-to-life non-existent creatures have become the norm.

The present invention also applicability to biometric identification. Closely related to the previous example is the analysis of real human individuals' walking characteristics. It is observed that people frequently can be identified quite easily at considerable distances simply by their gait, which seems as characteristic of a person as his fingerprints. This creates some remarkable possibilities for the identification and surveillance of individuals by extracting gait parameters as a signature.

It might be possible, for example, to establish the identity of a criminal suspect through analysis of gait characteristics from closed circuit television (CCTV) recording, even when the quality of these videos is too poor to isolate facial structure. A system could be constructed that would follow a particular individual through, say, a crowded airport or cityscape by identifying his walking signature via CCTV. An ordinary disguise, of course, will not fool such a system. Even the conscious attempt to walk differently may not succeed because the primary determinants of gait (such as the particular mechanical properties of the spine/pelvis interface) may be beyond conscious control.

The present invention, additionally, is applicable to detection, discrimination, and tracking of targets. There are many targets which move in three spatial dimensions and which it may be desirable to detect and track. For example, a particular aircraft or an enemy submarine in the ocean. Although there are far fewer channels than in gait analysis, these target tracking problems have a much higher noise floor.

There are many well-known techniques of adapting linear prediction to noisy signals, one of the simplest yet most effective being to manually adjust the diagonal coefficients of the autocorrelation matrix.

Multi-channel analysis can also be applied to video processing. Spatial measurements are not the only three-dimensional data which has to be compressed, processed, and transmitted. Color is (in the usual formulations) inherently three-dimensional in that a color is determined by three values: RGB, YUV (Luminance-Bandwidth-Chrominance), or any of the other color-space systems in use.

A video stream can be modeled by the same time series . . . $x_{n-2}$, $x_{n-1}$, $x_n$ approach that has been traditionally employed, except that now a channel corresponds to a single pixel on the viewing screen:

$$x_n = \begin{pmatrix} C_n(11) & \cdots & C_n(1N) \\ \vdots & \ddots & \vdots \\ C_n(M1) & \cdots & C_n(MN) \end{pmatrix}$$

where $C_n(jk)=(C_n(jk)^R\, C_n(jk)^G\, C_n(jk)^B)$ are the three color coordinates at time n in, for example, the RGB system of pixel j,k out of a total resolution of (M×N) pixels.

As mentioned previously, many hardware systems require the data to be arranged in the dual form of three value planes rather than planes of three values. With the large quantity of data represented by . . . $x_{n-2}$, $x_{n-1}$, $x_n$, compression is the key to successful video manipulation. For example, there is increasing pressure for corporate intranets to carry internal video signals and, for these applications, security is a critical necessity from the outset.

According to one embodiment, the present invention introduces the concept of photopic coordinates; it is shown that, just as in spatial data, color data is modeled effectively by quaternions. This construct permits application of the non-commutative methods to color images and video a reanalysis of the usual color space has to be performed, recognizing that color space has an inherent four-dimensional quality, in spite of the three-dimensional RGB and similar systems.

Many signal processing problems are presented in the form of overlapping frames laid over a basic single-channel time series:

$$\begin{array}{lllll}
\boxed{x_1 \;\; x_2 \;\; \cdots \;\; x_K} & x_{K+1} & & \cdots\, x_n \cdots & \\
x_1 \;\; \cdots & \boxed{x_{d+1} \;\; x_{d+2} \;\; \cdots \;\; x_{d+K}} & & \cdots\, x_n \cdots & \\
x_1 \;\; x_2 & \vdots & & & \\
x_1 \;\; x_2 \;\; \cdots & & \boxed{x_{md+1} \;\; x_{md+2} \;\; \cdots \;\; x_{md+K}} & \cdots & \\
 & & \vdots & &
\end{array}$$

High-resolution spectral analysis by linear prediction or some other method is performed separately within each frame $$\boxed{x_{md+1} \quad x_{md+2} \quad \cdots \quad x_{md+K}}$$

and then the resulting power spectra $P_0(\omega)$, $P_1(\omega)$, . . . , $P_m(\omega)$, . . . are analyzed as a new data sequence.

This is the traditional approach in voice analysis where the resulting spectra are presented in the well-known spectrogram form. However, it is used in many other applications such as the Doppler radar analysis of rotating bodies in which the distances of reflectors from the axis of rotation can be deduced from the instantaneous spectra of the returned signal.

More generally, this frame-based spectral analysis can be regarded as the demodulation of an FM (Frequency Modulation) signal because the information that is to be extracted is contained in the instantaneous spectra of the signal. Unfortunately, this within-frame approach ignores some of the most important information available; namely the between-frame correlations.

For example, in the rotating Doppler radar problem, a single rotating reflector gives rise to a sinusoidally oscillating frequency spike in the spectra sequence $P_0(\omega)$, $P_1(\omega)$, . . . , $P_m(\omega)$, . . . . The period of oscillation of this spike is the period of rotation of the reflector in space while the amplitude of the spike's oscillation is directly proportional to the distance of the reflector from the axis of rotation. These oscillation parameters cannot be read directly from any individual spectrum $P_m(\omega)$ because they are properties of the mutual correlations between the entire sequence $P_0(\omega)$, $P_1(\omega)$, . . . , $P_m(\omega)$, . . . .

This point is brought out especially well in the presence of noise which, as is well-known, has a strongly deleterious effect on any high-resolution spectral analysis method. An individual spectrum $P_m(\omega)$ may not exhibit any discernable spike but since it is known that there is an underlying oscillation in the series $P_0(\omega)$, $P_1(\omega)$, . . . , $P_m(\omega)$, . . . , a way exists to combine these spectra to filter out the cross-frame noise.

It is recognized that by imposing the frame structure on the time sequence, the signal is transformed into a multi-channel sequence:

$$\boxed{\begin{matrix} x_1 \\ x_2 \\ \vdots \\ x_K \end{matrix}}, \boxed{\begin{matrix} x_{d+1} \\ x_{d+2} \\ \vdots \\ x_{d+K} \end{matrix}}, \cdots, \boxed{\begin{matrix} x_{md+1} \\ x_{md+2} \\ \vdots \\ x_{md+K} \end{matrix}}, \cdots$$

with the number of channels K equal to the frame width.

As is more fully described below, linear predictive analysis of such a multi-channel sequence gives rise to coefficients $a_1$, . . . , $a_m$, . . . which are (K×K) matrices rather than single scalars. Thus, the spectra $P_m(\omega)$ produced by these coefficients are themselves (K×K) matrices.

However, the correlations that are sought after, such as the oscillation patterns produced by rotating radar reflectors, cause these power spectra matrix sequences $P_0(\omega)$, $P_1(\omega)$, . . . , $P_m(\omega)$, . . . to become singular; i.e., the autocorrelation matrices of $P_0(\omega)$, $P_1(\omega)$, . . . , $P_m(\omega)$, . . . (which are matrices whose entries are themselves matrices) becomes non-invertible. In fact, the non-inevitability of this matrix is equivalent to cross-spectral correlation.

Unfortunately, the prior approaches to linear prediction break down at this exact point because these conventional approaches cannot handle the problem of channel degeneracy.

The present invention, according to one embodiment, advantageously operates in the presence of highly degenerate data.

As noted, the present invention can be utilized in the area of optics. It has been understood that optical processing is a form of linear filtering in which the two-dimensional spatial Fourier transforms of the input images are altered by wave-number-dependent amplitudes of the lens and other transmission media. At the same time, light itself has a temporal frequency parameter ν which determines the propagation speed and the direction of the wave fronts by means of the frequency-dependent refractive index. Thus, the abstract optical design and analysis problem is determining the relation between the four-component wavevector $(\vec{\sigma},\nu)$ and the on the four-component space-time vector $(\vec{x},t)$ on each point of a wavefront as it moves through the optical system.

Both $(\vec{\sigma},\nu)$ and $(\vec{x},t)$ for a single point on a wavefront can be viewed as series of four-dimensional data, and thus, a mesh of points on a wavefront generates two sets of two-dimensional arrays of four-dimensional data. As is seen, $(\vec{\sigma},\nu)$,$(\vec{x},t)$ are naturally structured as quaternions. There are many possibilities for joint linear predictive analysis of these series. In particular, estimating the four-dimensional power spectra by solving for the all-pole filter produced by the linear prediction model.

Passing from two-dimensional arrays of three-dimensional data, there are many applications which require three-dimensional arrays of three-dimension data. For example, the stress of a body is characterized by giving, for every point (x,y,z) inside the unstressed material, the point (x+εx,y+εy,z+εy) to which (x,y,z) has been moved. If a uniform grid of points (lΔx,mΔy,nΔz), $\{l,m,n\} \subseteq \mathbf{Z}^3$ defines the body, then the three-dimensional array $$\left(\begin{matrix} \vdots \\ \cdots \quad (\delta x, \delta y, \delta z)_{l,m,n} \quad \cdots \\ \vdots \end{matrix}\right) \rightarrow \Bigg)$$

of three-dimensional data approximates the stress. For example, from this matrix, an approximation of the stress tensor may be derived.

A good example of the use of these ideas is three-dimensional, dynamic modeling of the heart. The stress matrix can be obtained from real-time tomography and then linear predictive modeling can be applied. This has many interesting diagnostic applications, comparable to a kind of spatial EKG (Electrocardiogram).

As is discussed later, the system response of the quaternion linear filter is a function of two complex values (rather than one as in the commutative situation). Thus the "poles" of the system response really is a collection of polar surfaces in $\mathbf{C}\times\mathbf{C}\cong\mathbf{R}^4$. Because of the strong quasi-periodicities in heart motion and because the linear prediction filter is all-pole, these polar surfaces can be near to the unit 3-sphere (the four-dimensional version of the unit circle) in $\mathbf{R}^4$.

The stability of the filter is determined by the geometry of these surfaces, especially by how close they approach the 3-sphere. It is likely that this can be translated into information about the stability of the heart motion, which is of great interest to cardiologists.

Figure 4:
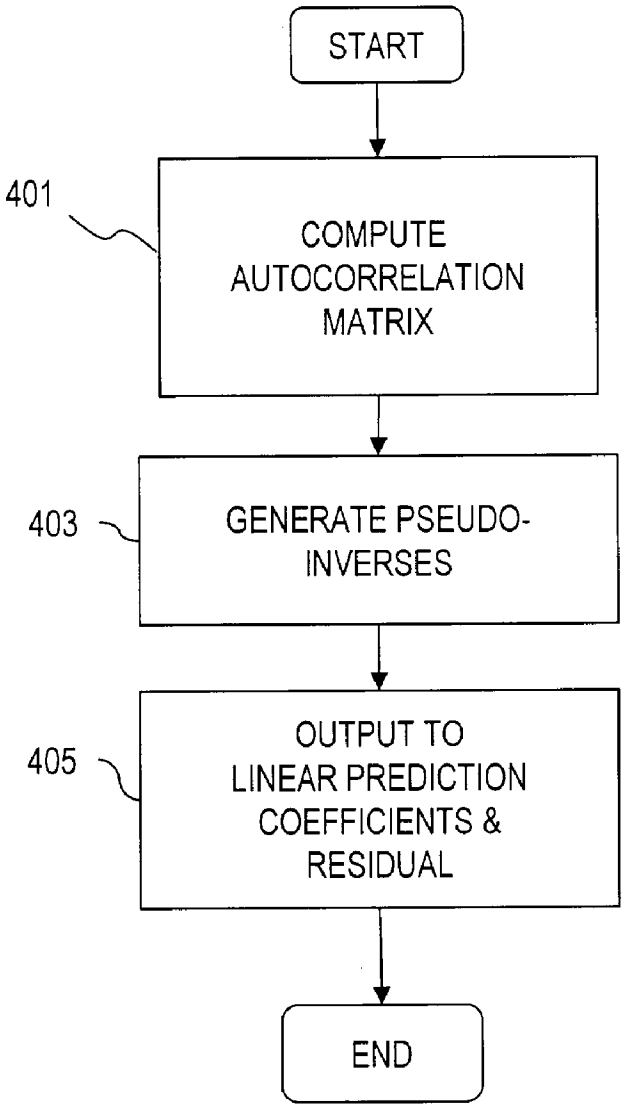
FIG. 4 is a flowchart of the operation for performing non-commutative linear prediction in the system of FIG. 1.

FIG. 4 is a flowchart of the operation for performing non-commutative linear prediction in the system of FIG. 1. Linear prediction (LP) has been a mainstay of signal processing, and provides, among other advantages, compression and encryption of data. Linear prediction and linear predictive coding, according to one embodiment of the present invention, requires computation of an autocorrelation matrix of the multi-channel data, as in step 301. While theoretically creating the possibility of significant compression of multi-channel sets, such high degrees of correlation also create algorithmic problems because it causes the key matrices inside the algorithms to become singular or, at least, highly unstable. This phenomenon can be termed "degeneracy" because it is the same effect which occurs in many physical situations in which energy levels coalesce due to loss of dimensionality.

Degeneracy cannot be removed simply by looking for "bad" channels and eliminating them. For one thing, such a scheme is too costly in time, and fundamentally flawed, because degeneracy is a global or system-wide phenomenon. The problem of degeneracy of multi-channel data has generally been ignored by algorithm designers. For example, traditional approaches only consider the case in which the autocorrelation matrices are either non-singular (another way of saying the system is not degenerate) or that the singularity can be confined to a few deterministic channels. Without this assumption, the popular linear prediction method, referred to as the Levinson algorithm, fails in its usual formulation.

Real multi-channel data, as discussed above, can be expected to be highly degenerate. The present invention, according to one embodiment, can be used to formulate a version of the Levinson algorithm that does not assume non-degenerate data. This is accomplished by examining the manner in which matrix inverses enter into the algorithm; such inverses can be replaced by pseudo-inverses. This is an important advance in multi-channel linear prediction even in the standard commutative scalar formulations.

In step 303, pseudo-inverses of the autocorrelation matrix are generated, thereby overcoming any limitations stemming for the non-inevitability problem. The linear predictor then outputs the linear prediction matrix containing the LP coefficients and residuals, per step 305.

The general idea of compression is that any data set contains hidden redundancy which can be removed, thus reducing the bandwidth required for the data's storage and transmission. In particular, predictive coding removes the redundancy of a time series $\ldots x_{n-2}, x_{n-1}, x_n$ by determining a predictor function $\wp(\ )$ and a new residual data series $\ldots e_{n-2}, e_{n-1}, e_n$ for which $$x_n=\wp(x_{n-1},x_{n-2},\ldots)+e_n$$

for every n in an appropriate range. Ideally, $\wp(\ )$ will depend on relatively few parameters, analogous to the coefficients of a system of differential equations and which are transmitted at the full bit-width, while $\ldots e_{n-2}, e_{n-1}, e_n$ will have relatively low dynamic range and thus can be transmitted with fewer bits/symbol/time than the original series. The series, $\ldots e_{n-2}, e_{n-1}, e_n$, can be thought of as equivalent to the series $\ldots x_{n-2}, x_{n-1}, x_n$ but with the deterministic redundancy removed by the predictor function $\wp(\ )$. Equivalently, $\ldots e_{n-2}, e_{n-1}, e_n$ is "whiter" than $\ldots x_{n-2}, x_{n-1}, x_n$; i.e., has higher entropy per symbol.

The compression can be increased by allowing lossy reconstruction in which only a fraction (possibly none) of the residual series $\ldots e_{n-2}, e_{n-1}, e_n$ is transmitted/stored. The missing residuals are reconstructed as 0 or some other appropriate value.

Encryption is closely associated with compression. Encryption can be combined with compression by encrypting the $\wp(\ )$ parameters, the residuals $\ldots e_{n-2}, e_{n-1}, e_n$, or both. This can be viewed as adding encoded redundancy back into the compressed signal, analogous to the way error-checking adds unencoded redundancy.

Linear prediction and linear predictive coding use a finite linear function $$\wp(x_{n-1},x_{n-2},x_{n-3},\ldots)=-a_1x_{n-1}-a_2x_{n-2}-a_3x_{n-3}\ldots -a_Mx_{n-M}$$

with constant coefficients as the predictor.

So defining $a_0=1$, the full LP model of order M is $$\sum_{m=0}^{M} a_m x_{n-m} = e_n$$

It is noted that when each $x_n$ is a K-channel datum, the coefficients $a_m$ must be (K×K) matrices over the scalars (typically R,C, or H).

A number of non-LP coding schemes exists, such as the Fourier-based JPEG (Joint Photographic Experts Group) standard. The LP models have a universality and tractability which make them benchmarks.

Linear prediction becomes statistical when a probabilistic model is assumed for the residual series, the most common being independence between times and multi-normal within a time; that is, between channels at a single moment of time when each $x_n$ is a multi-channel data sample.

The property enjoyed by the multi-normal density $$\phi(x_1,\cdots,x_n)=\phi(\vec{x})=\frac{1}{(2\pi)^{n/2}}\frac{1}{\sqrt{\det\Sigma}}e^{-\frac{1}{2}(\vec{x}-\vec{\mu})^T\Sigma^{-1}(\vec{x}-\vec{\mu})},$$

where $\Sigma$ is the covariance matrix and $\vec{\mu}$ the mean of $\vec{x}$, and no other distribution is that uncorrelated multi-normal random variables are statistically independent. As a result, "independent" in the sense of linear algebra is identical to "independent" in the sense of probability theory. By linearly transforming the variables to the principal axes determined by the eigenstructure of $\Sigma$, consideration can be narrowed to independent, normally distributed random variables. The residuals can be tested for significance using standard $\chi^2$- or F-tests, analysis of variance (ANOVA) tables can be constructed, and the rest.

In essence, then, any advancement of linear predictive coding must either improve the linear algebra or improve the statistics or both.

The present invention advances the linear algebra by introducing non-commutative methods, with the quaternion ring H as a special case, into the science of data coding. The present invention also advances the statistics by reanalyzing the basic assumptions relating linear models to stationary, ergodic processes. In particular, it is demonstrated by analyzing source texts that linear prediction is not a fundamentally statistical technique and is, rather, a method for extracting structured information from structured messages.

Like all signal processing methodologies, the three-dimensional, non-commutative technique is a series of modeling "choices," not just one algorithm applicable to all situations. As a result of this and due to the unfamiliarity of many of the mathematical concepts being used, an attempt is made to provide a reasonably self-contained presentation of the context in which the modeling takes place.

In statistical signal processing, LP appears as autoregressive models (AR). These are a special case of autoregressive-moving average models (ARMA) which, unlike AR models, have both poles and zeros; i.e. modes and anti-modes. For example, in radar applications, the same general class of techniques are usually called autoregressive spectral analysis and have found diverse applications including target identification through LP analysis of Doppler shifts.

As pointed out previously, the K-channel linear predictive model is as follows:

$$\sum_{m=0}^{M} a_m x_{n-m} = e_n,$$

which requires the coefficients $a_m$ to be (K×K) matrices which, in general, do not commute: a·b=b·a. As is discussed below, when the entries of the matrices $a_m$ themselves are commutative, the non-commutativity of the $a_m$ can be controlled at the determinants since det(a·b)=det(b·a) even when a·b=b·a.

However, once the matrices are composed of non-commutative entries, the determinant is no longer useful. This results, for example, if higher-order prediction is to be performed in which multiple channels of series (which are themselves multi-channel series are utilized). This is not an abstraction: many real series are presented in this form. For example, it may be the case that the multi-channel readings of geophysical experiments from many separate locations are used and it is desired to assemble them all into a single predictive model for, say, plate tectonic research. It is not the case that the model derived by representing all channels into a large, flat matrix is the same as that obtained by regarding the coefficients $a_m$ as matrices whose entries are also matrices.

The general linear prediction problem is thus concerned with the algebraic properties of the set $\mathcal{M}$(n,m,A) of (n×m) matrices whose entries are in some scalar structure A. Appropriate scalar structures is discussed in below with respect to quaternion representations. In many cases, however, A is itself a matrix structure $\mathcal{M}$(k,l,B). There is thus a tendency to regard a∈$\mathcal{M}$(n,m,A), with A=$\mathcal{M}$(k,l,B), as "really" structured as a∈$\mathcal{M}$(nk,ml,B):

$$\begin{array}{c} \leftarrow m \rightarrow \\ \uparrow n \downarrow \end{array} \begin{pmatrix} a_{11} & \cdots & a_{1m} \\ \vdots & \ddots & \vdots \\ a_{n1} & \cdots & a_{nm} \end{pmatrix}, \quad a_{\nu\mu} = \begin{array}{c} \leftarrow l \rightarrow \\ \uparrow k \downarrow \end{array} \begin{pmatrix} a_{\nu\mu,11} & & a_{\nu\mu,1l} \\ & & \\ a_{\nu\mu,k1} & & a_{\nu\mu,kl} \end{pmatrix}$$

$$\Updownarrow$$

-continued $$\begin{array}{c} \leftarrow ml \rightarrow \\ \uparrow nk \downarrow \end{array} \left(\begin{array}{cc|cc|c|c|cc} a_{11,11} & \cdots & a_{12,11} & \cdots & & & \cdots & a_{1m,1l} \\ \vdots & \ddots & \vdots & \ddots & & & \iddots & \vdots \\ \hline & & & & & & & \\ \hline \vdots & \iddots & \vdots & \iddots & & & \ddots & \vdots \\ a_{n1,k1} & \cdots & a_{n2,k1} & \cdots & & & \cdots & a_{nm,kl} \end{array}\right).$$

However, this is a distorted way of viewing the problem because the internal coefficients $a_{\nu\mu,\sigma\tau}$ are functioning on a deeper level than the external coefficients $a_{\nu\mu}$. In more concrete terms, as mentioned above the solution to the linear prediction problem corresponding to a∈$\mathcal{M}$(n,m,A) has nothing whatsoever to do with the linear prediction problem corresponding to a∈$\mathcal{M}$(nk,ml,B).

The correct metaphor is to regard the expression $\mathcal{M}$(n,m,−) as defining a matrix class in the sense of object-oriented programming, then for any object A, $\mathcal{M}$(n,m,A) is an object inheriting the properties of $\mathcal{M}$(n,m,−), and utilizing the arithmetic of A to define operations such as matrix multiplication and addition. A itself inherits from a general scalar class defining the arithmetic of A. However, these classes are so general that $\mathcal{M}$(n,m,A) itself can be regarded as a scalar object, using its defined arithmetic. Accordingly, in the other direction, the scalar object A might itself be some matrix object $\mathcal{M}$(k,l,B).

In spite of the degree of abstraction this metaphor requires, it is the only one which correctly captures the general multi-channel situation. It is easy to imagine real-world multi-channel situations, such as the geophysics situation described previously, in which deep inheritance hierarchies are generated.

The present invention, according to one embodiment, addresses special cases of this general data-structuring problem, in which the introduction of non-commutative algebra into signal processing is a major advance towards a solution of the general case. The reason that multi-channel linear prediction produces significant data compression is the large cross-channel and cross-time correlation. This implies a high degree of redundancy in the datasets which can be removed, thereby reducing the bandwidth requirements.

Correlations are introduced in mechanical finite-element systems by physical constraints of shape, boundary conditions, material properties, and the like as well as the inertia of components with mass. This is also true for animal/robotic motion whose strongest constraints are due the semi-rigid structure of bone or metal.

In fact, as noted previously, multi-channel data is actually steeped with correlations—which was not an issue for single-channel processing. For example, when a single-channel linear predictor has been able to reduce the prediction error of a signal to 0, this can be interpreted as a sign of highly successful compression: it is demonstrated that the channel is carrying a deterministic sum of damped exponentials whose values can be determined by locating the roots of the characteristic polynomial of the system. In reality, things are not this simple; in practice, one regards a "perfect" linear prediction as indicative of too many coefficients and reduces the model order accordingly. However, things are far more complicated for multi-channel analysis because a large number of "perfect" channels are used.

That part of ordinary calculus, of any number of real or complex variables, which goes beyond simple algebra, is based in the fact that Ris a metric space for which the compact sets are precisely the closed, bounded sets. The higher-dimensional spaces $\mathbf{R}^n, \mathbf{C}^n$ inherit the same property. The algebra of R,C plus the simple geometric combinatorics of covering regions by boxes allow all of calculus, complex, analysis, Fourier series and integrals, and the rest to be built up in the standard manner from this compactness property of R.

Topologically and metrically, the quaternion ring is simply $\mathbf{R}^4$; with careful use of quaternion algebra (especially the non-commutativity), the same development can be followed for H. All the standard results such as the Cauchy Integral Theorem, the Implicit Function Theorem, and the like have their quaternion analogs (often in left- and right-forms because of non-commutativity).

As a consequence, there is no problem in developing H-versions of z-transforms and Laurent series, hence the P(z) and D(z) of the previous section. In fact, the theory of quaternion system functions is much richer than for the complex field because as is shown later, a quaternion variable z consists of two independent complex variables $$\begin{pmatrix} z_+ \\ z_- \end{pmatrix}.$$

Many unexpected frequency-domain phenomena will appear, unknown from the one variable situation, because of the geometric and analytic interactions of $z_+$ and $z_-$.

Because His non-commutative, the det( ) operator does not behave "properly". The most important property of det( ) which fails over His its invariance under multiplication of columns or rows by a scalar; i.e., it is generally the case that $$\det\begin{pmatrix} a_{11} & & \\ \vdots & \cdots & k\begin{pmatrix} a_{1j} \\ a_{ij} \\ a_{Mj} \end{pmatrix} & \cdots & a_{1N} \\ & & a_{iN} \\ & & a_{MN} \end{pmatrix} \neq k \det\begin{pmatrix} a_{11} & & \\ \vdots & \cdots & \begin{pmatrix} a_{1j} \\ a_{ij} \\ a_{Mj} \end{pmatrix} & \cdots & a_{1N} \\ & & a_{iN} \\ & & a_{MN} \end{pmatrix},$$

for k∈H.

As a result, basic identities such as det(ab)=det(a)det(b) and Cramer's Rule also fail.

Importantly, it is not the case that a matrix a over His invertible if and only if det(a) is invertible in H. This is because the matrix adjoint $a^{adj}$ generally satisfies $a \cdot a^{adj} \neq \det(a) \cdot 1$ over non-commutative rings.

The present invention advantageously permits application of the Levinson algorithm in a wide class of cases in which the autocorrelation coefficients are not in a commutative field. In particular, it is shown that the modified Levinson algorithm applies to quaternion-valued autocorrelations, hence, for example, to 3 and (3+1)-dimensional data.

The algebra of complex numbers can be viewed as ordered pairs of real numbers (a,b), referred to as couplets. Addition was defined by the rule (a,b)+(c,d)=(a+c,b+d) and, most importantly, multiplication defined by the rule:

$$(a,b)\cdot(c,d)=(ac-bd,ad-bc).$$

It has been shown that with these definitions, couplets could be added, subtracted, multiplied, and, when the divisor did not equal (0,0), divided as well.

Thus, $i=\sqrt{-1}$ can be simply defined as the couplet (0,1), while the couplet 1 (which is different in an abstract sense from the number 1) was defined to be (1,0).

Any couplet (a,b) could then be written uniquely in the form $$(a,b)=a(1,0)+b(0,1)=a1+bi=a+bi$$

and the link to the complex numbers was complete.

An equivalent representation of the complex number a+bi is the (2×2) real matrix:

$$[\![ a+bi ]\!] = \begin{pmatrix} a & b \\ -b & a \end{pmatrix}.$$

This representation is important for understanding the more complicated quaternion representations.

Using the ordinary laws of matrix arithmetic, the following exists:

$$[\![ a+bi ]\!] + [\![ c+di ]\!] = \begin{pmatrix} a & b \\ -b & a \end{pmatrix} + \begin{pmatrix} c & d \\ -d & c \end{pmatrix} = \begin{pmatrix} a+c & b+d \\ -(b+d) & a+c \end{pmatrix} = [\![ (a+bi)+(c+di) ]\!]$$

and $$s\cdot[\![ a+bi ]\!] = s\cdot\begin{pmatrix} a & b \\ -b & a \end{pmatrix} = \begin{pmatrix} s\cdot a & s\cdot b \\ -s\cdot b & s\cdot a \end{pmatrix} = [\![ s\cdot(a+bi) ]\!], \text{ for any } s \in R.$$

Most significantly, $$\begin{aligned} [\![ a+bi ]\!]\cdot[\![ c+di ]\!] &= \begin{pmatrix} a & b \\ -b & a \end{pmatrix}\begin{pmatrix} c & d \\ -d & c \end{pmatrix} \\ &= \begin{pmatrix} ac-bd & ad+bc \\ -(ad+bc) & ac-bd \end{pmatrix} \\ &= [\![ (a+bi)\cdot(c+di) ]\!]. \end{aligned}$$

In this representation, $$1 = [\![ 1 ]\!] = \begin{pmatrix} 1 & 0 \\ 0 & 1 \end{pmatrix}, \; I = [\![ i ]\!] = \begin{pmatrix} 0 & 1 \\ -1 & 0 \end{pmatrix}$$

and thus $$[\![ a+bi ]\!] = \begin{pmatrix} a & b \\ -b & a \end{pmatrix} = a\cdot\begin{pmatrix} 1 & 0 \\ 0 & 1 \end{pmatrix} + b\cdot\begin{pmatrix} 0 & b \\ -b & 0 \end{pmatrix} = a\cdot 1 + b\cdot I$$

$$I^2 = \begin{pmatrix} 0 & 1 \\ -1 & 0 \end{pmatrix}\begin{pmatrix} 0 & 1 \\ -1 & 0 \end{pmatrix} = \begin{pmatrix} -1 & 0 \\ 0 & -1 \end{pmatrix} = -1$$

and so, once again, the law $i^2=-1$ receives a clear interpretation.

Also the complex conjugate is represented by the transpose:

$$[\![(a+bi)^*]\!] = [\![a-bi]\!] = \begin{pmatrix} a & -b \\ b & a \end{pmatrix} = \begin{pmatrix} a & b \\ -b & a \end{pmatrix}^T = [\![a+bi]\!]^T$$

and the squared norm $|z|^2$ represented by the determinant $$|a+bi|^2 = a^2+b^2 = \det\begin{pmatrix} a & b \\ -b & a \end{pmatrix} = \det[\![a+bi]\!].$$

The following is noted:

$$\begin{pmatrix} a & b \\ -b & a \end{pmatrix}\cdot\begin{pmatrix} a & b \\ -b & a \end{pmatrix}^T = \begin{pmatrix} a & b \\ -b & a \end{pmatrix}\cdot\begin{pmatrix} a & -b \\ b & a \end{pmatrix} = (a^2+b^2)\cdot\begin{pmatrix} 1 & 0 \\ 0 & 1 \end{pmatrix} = \left[\det\begin{pmatrix} a & b \\ -b & a \end{pmatrix}\right]\cdot\begin{pmatrix} 1 & 0 \\ 0 & 1 \end{pmatrix}$$

and similarly $$\begin{pmatrix} a & b \\ -b & a \end{pmatrix}^T\cdot\begin{pmatrix} a & b \\ -b & a \end{pmatrix} = \left[\det\begin{pmatrix} a & b \\ -b & a \end{pmatrix}\right]\cdot\begin{pmatrix} 1 & 0 \\ 0 & 1 \end{pmatrix}.$$

A real matrix C is called "orthogonal" if $CC^T=C^TC=1$, and the set of (n×n) real orthogonal matrices is denoted O(n). O(n) is a group under multiplication. A real matrix C is "extended orthogonal" if it satisfies the more general rule $$CC^T=C^TC=r\cdot 1$$

for some $r\epsilon\mathbf{R}$ and the set of (n×n) extended orthogonal matrices is denoted $^+O(n)$. Thus, $O(n)\subseteq{}^+O(n)$. Since $nr=\mathrm{trace}(r\cdot 1)=\mathrm{trace}(CC^T)\geqq 0$, where the trace of a matrix is the sum of the diagonal coefficients, r is necessarily non-negative and $r=0\Leftrightarrow C=0$. So $^+O(n)-\{0\}$ forms a group under matrix multiplication.

If C is orthogonal, then $\det(C)^2=\det(C)\det(C^T)=\det(CC^T)=\det(1)=1$ so $\det(C)=\pm 1$. An orthogonal matrix with $\det(C)=1$ is called "special orthogonal," and the set of (n×n) special orthogonal matrices (which is also a group) is denoted SO(n).

Analogously, an extended orthogonal matrix C is defined to be "special extended orthogonal" if $\det(C)\geqq 0$ and denote the set of special extended orthogonal matrices by $S^+O(n)$. Again $SO(n)\subseteq S^+O(n)$ and $S^+O(n)-\{0\}$ forms a group under multiplication.

It is observed that $C\epsilon S^+O(n)$ if and only if $C=0$ or ($\det(C)>0$ and $$\frac{1}{\sqrt[n]{\det(C)}}$$

$C\epsilon SO(n)$). This implies that every $C\epsilon S^+O(n)$ has a unique representation $C=sR$, $s\epsilon\mathbf{R}, s\geqq 0$, $R\epsilon SO(n)$ and conversely. In particular, $SO(n)=\{C\epsilon S^+O(n)|\det(C)=1\}$.

It can also be shown that a (2×2) real matrix C is special extended orthogonal if and only if it is of the form:

$$C = \begin{pmatrix} a & b \\ -b & a \end{pmatrix}, a, b \in R,$$

which are precisely the matrices with which Crepresents. Thus this representation of Cis denoted by the $S^+O(2)$ representation.

In particular, the unit circle $S^1=\{(x_1,x_2)\epsilon\mathbf{R}^2; x_1^2+x_2^2=1\}\approx\{z\epsilon\mathbf{C}; |z|^2=1\}$ is isomorphic to the real rotation group SO(2) by means of the representation [].

Instead of representing i by $$\begin{pmatrix} 0 & 1 \\ -1 & 0 \end{pmatrix},$$

it could be represented by $$\begin{pmatrix} 0 & -1 \\ 1 & 0 \end{pmatrix},$$

and nothing in the arithmetic would differ. This is precisely the same phenomenon as in linear algebra in which it is more satisfactory in an abstract sense to define vector spaces merely by the laws they satisfy but in which computation is best performed in coordinate form by selecting some arbitrary basis.

A three-component analog of complex numbers (i.e., "triplets") provides a useful arithmetic structure on three-dimensional space, just as the complex numbers put a useful arithmetic structure on two-dimensional space. The theory of addition and scalar multiplication for triplets, are as follows:

$$(a,b,c)+(d,e,f)=(a+d,b+e,c+f)$$

$$s\cdot(a,b,c)=(s\cdot a,s\cdot b,s\cdot c)$$

However, multiplying triplets is more difficult. Two ways of multiplication exist: dot product, cross product (i.e., vector product). The dot product (or the scalar product) is as follows:

$$(a,b,c)\cdot(d,e,f)=ad+be+cf$$

However, this product does not produce a triplet.

The other way is known as the cross product is as follows:

$$(a,b,c)\times(d,e,f)=(bf-ce,cd-af,ae-bd).$$

The cross product has the advantage of producing a triplet from a pair of triplets, but fails to allow division. When A,B are triplets, the equation $A\times X=B$ is generally not solvable for X even when $A\neq 0$. However, the cross product contained the seed of the eventual solution in the anti-commutative law $A\times B=-B\times A$.

It is noted that three-dimensional space must be supplemented with a fourth temporal or scale dimension in order to form a complete system. Thus, 3-dimensional geometry must be embedded inside a (3+1)-dimensional geometry in order to have enough structure to allow certain types of objects (points at infinity, reciprocals of triplets, etc.) to exist.

The four-component objects named "quaternions," have the usual addition and scalar multiplication laws. The definition of quaternion multiplication is as follows:

$$(a,b,c,d)\cdot(e,f,g,h)=(ae-bf-cg-dh,af+be+ch-dg,ag+ce+df-bh,ah+bg+de-cf)$$

Because of the complexity, this formula is not used for computation.

As with the representation of complex numbers as couplets, the first step is to define the units:

$$1=(1,0,0,0)$$

$$I=(0,1,0,0)$$

$$J=(0,0,1,0)$$

$$K=(0,0,0,1)$$

The previous formula then shows that I,J,K satisfy the multiplication rules:

$$I^2=J^2=K^2=IJK=-1.$$

From these relations follow the permutation laws:

$$IJ=-JI=K$$

$$JK=-KJ=I$$

$$KI=-IK=J$$

and since 1a+Ib+Jc+Kd=(a,b,c,d)=a1+bI+cJ+cK, the usual laws of arithmetic combined with the above relations among the units defines quaternion multiplication completely. The quaternions is denoted as H.

A quaternion has many representations, the most basic being the 4-vector form q=a1+bI+cJ+cK. Typically, the "1" is omitted (or identified with the number 1 where no ambiguity will result): q=a+bI+cJ+cK.

q=a+bI+cJ+cK naturally decomposes into its scalar part $Sc(q)=a\epsilon\mathbf{R}$ and its vector (or principal) part $Vc(q)=(bI+cJ+dK)\epsilon\mathbf{R}^3$, where the quaternion units I,J,K are regarded as unit vectors in $\mathbf{R}^3$ forming a right-hand orthogonal basis.

q=Sc(q)+Vc(q) always holds. The expression, $q=a+\vec{v}$, is used to indicate Sc(q)=a and $Vc(q)=\vec{v}$. This can be referred to as the (3+1)-vector representation of a quaternion.

The addition and scalar multiplication laws in the (3+1) form are simply $$(a+\vec{v})+(b+\vec{w})=(a+b)+(\vec{v}+\vec{w})$$

$$s\cdot(a+\vec{v})=(s\cdot a+s\cdot\vec{v}),s\epsilon\mathbf{R}$$

However, the quaternion multiplication law in (3+1) form reveals the deep connection to the structure of three-dimensional space:

$$(a+\vec{v})\cdot(b+\vec{w})=(ab-\vec{v}\bullet\vec{w})+(a\vec{w}+b\vec{v})+(\vec{v}\times\vec{w}).$$

In the above expression, $\vec{v}\bullet\vec{w}$ denotes dot product (cI+dJ+eK)═(fI+gJ+hK)=(cf+dg+eh) while $\vec{v}\times\vec{w}$ denotes cross product $$(cI+dJ+eK)\times(fI+gJ+hK)=\begin{vmatrix} c & f & I \\ d & g & J \\ e & h & K \end{vmatrix}=(dh-eg)I+(ef-ch)J+(cg-df)K.$$

Since ab is ordinary scalar multiplication and $a\vec{w}$,$b\vec{v}$ are just ordinary multiplications of a vector by a scalar, it can be seen that quaternion multiplication contains within it all four ways in which a pair of (3+1)-vectors can be multiplied.

It is suggestive that if the two relativistic spacetime intervals $(\Delta x_1,\Delta y_1,\Delta z_1,c\Delta t_1),(\Delta x_2,\Delta y_2,\Delta z_2,c\Delta t_2)$ is represented by the quaternions $$\Delta q_1=c\Delta t_1+(\Delta x_1)I+(\Delta y_1)J+(\Delta z_1)K,$$

$$\Delta q_2=c\Delta t_2+(\Delta x_2)I+(\Delta y_2)J+(\Delta z_2)K$$

then $$Sc(\Delta q_1\cdot\Delta q_2)=c^2(\Delta t_1\Delta t_2)-(\Delta x_1\Delta x_2+\Delta y_1\Delta y_2+\Delta z_1\Delta z_2),$$

the familiar Minkowski scalar product.

The (3+1) product formula also shows that for any pure vector $\vec{v}$, $\vec{v}^2=-|\vec{v}|^2\epsilon\mathbf{R}$. In particular, when $\hat{v}$ is an ordinary unit vector in 3-space, $\hat{v}^2=-1$, which generalizes the rules for I,J,K.

As with the complex numbers, quaternions have a conjugation operation q*:

$$q^*=(a+bI+cJ+dK)^*=(a-bI-cJ-dK).$$

In (3+1) form this is $(a+\vec{v})^*=(a-\vec{v})$. Generalizing the C-formulae $$(z^*)^*=z,\ \mathrm{Re}(z)=\frac{1}{2}(z+z^*),\ i\,\mathrm{Im}(z)=\frac{1}{2}(z-z^*)$$

yields the following:

$$(q^*)^*=q$$

$$Sc(q)=\frac{1}{2}(q+q^*).$$

$$Vc(q)=\frac{1}{2}(q-q^*)$$

Quaternions also have a norm generalizing the complex $|z|=\sqrt{zz^*}$:

$$|q|=\sqrt{qq^*}=\sqrt{q^*q}=\sqrt{(a^2+b^2+c^2+d^2)}\epsilon\mathbf{R}$$

and, as with C, $|q|^2\geqq 0$ and ($|q|=0\Leftrightarrow q=0$). In (3+1) form the norm is calculated by $|a+\vec{v}|=\sqrt{a^2+\vec{v}\bullet\vec{v}}$.

A unit quaternion is defined to be a $u\epsilon\mathbf{H}$ such that |u|=1. It is noted that the quaternion units ±1,±I,±J,±K are all unit quaternions.

The chief peculiarity of quaternion arithmetic is the failure of the commutative law: for quaternions q,r, whereby generally q·r≠r·q; even the units do not commute: I·J=−J·I, etc. The (3+1) form $(a+\vec{v})\cdot(b+\vec{w})=(ab-\vec{v}\bullet\vec{w})+(a\vec{w}+b$ $\vec{v})+(\vec{v}\times\vec{w})$ shows this most clearly. All the multiplication operations in this expression are commutative except the cross product $\vec{v}\times\vec{w}$ which satisfies $\vec{v}\times\vec{w}=-\vec{w}\times\vec{v}$, hence is the source of non-commutativity. This also shows that if Vc(q) and Vc(r) are parallel vectors in $\mathbf{R}^3$ then q·r=r·q.

An important formula is the anti-commutative conjugate law $$(q\cdot r)^*=r^*\cdot q^*$$

which is most easily proved in the (3+1) form. Combined with the previous law (q*)*=q, this shows that conjugation is an anti-involution of H.

Recall that the reciprocal of a non-zero complex number z can be written in the form $$z^{-1}=\frac{z^*}{|z|^2}$$

and this also holds for quaternions:

$$q^{-1}=\frac{q^*}{|q|^2},\ q\neq 0$$

as is apparent by the calculation $$q\left(\frac{q^*}{|q|^2}\right)=\frac{qq^*}{|q|^2}=\frac{|q|^2}{|q|^2}=1$$

and similarly for $$\left(\frac{q^*}{|q|^2}\right)q.$$

As with all non-commutative groups, inverses anti-commute $$(q\neq 0,r\neq 0)\Rightarrow((qr)^{-1}=r^{-1}q^{-1}).$$

So Hpossesses the four basic arithmetic operations but has a non-commutative multiplication, which is the definition of what is called a division ring.

A known result of Frobenius states that the only division rings which are finite-dimensional extensions of Rare Ritself (one-dimensional), the complex numbers C(two-dimensional), and the quaternions H((3+1)-dimensional). This is another example of the exceptional properties of (3+1)-dimensional space.

The (n×n) identity matrix $$\begin{pmatrix} 1 & 0 & \cdots & & 0 \\ 0 & \ddots & & & \vdots \\ \vdots & & 1 & & \vdots \\ \vdots & & & \ddots & 0 \\ 0 & & \cdots & 0 & 1 \end{pmatrix}$$

is denoted 1 to avoid confusion with the quaternion unit I.

There are many notations for the quaternion units; e.g., i,j,k; $\hat{\imath},\hat{\jmath},\hat{k}$; and I,J,K. A more general definition of the quaternions, based on is obtained as follows:

Let kbe a commutative field and e,f,g∈k−{0}. H(k,e,f,g), the quaternions over k, is defined as the smallest k-algebra which contains elements I,J,K∈H(k,e,f,g) satisfying the relations $$I^2=-ef,J^2=-eg,K^2=-fg,IJK=-efg.$$

It can then be shown that $$IJ=-JI=eK$$

$$JK=-KJ=gI.$$

$$KI=-IK=fJ$$

Any q∈H(k,e,f,g) can be written uniquely in the form q=a+bI+cJ+dK, a,b,c,d∈k with conjugate q*=a−bI−cJ−dK and norm $^2|q|=a^2+efb^2+egc^2+fgd^2$.

An interesting situation is when the quadratic form $w^2+efx^2+egy^2+fgz^2$ over kis definite; i.e., $(w^2+efx^2+egy^2+fgz^2=0)\Rightarrow(w=x=y=z=0)$. In particular, for this to hold, none of −ef,−eg,−fg can be squares in k. In this case, H(k,e,f,g) is a division ring as well as a four-dimensional k-algebra.

H(R,1,1,1)=H are just Hamilton's quaternions.

In order to show that H(k,e,f,g) exists, it is noted that the typical polynomial algebra constructions fail because the non-commutativity of the quaternion units.

Let $\mathfrak{A}$be a k-algebra, then the tensor algebra of $\mathfrak{A}$over kis the graded k-algebra $$T_k(A)=\coprod_{n\geq 0}(A\otimes_k\ \cdots\ \otimes_k A)_{n\ factors}$$

with product defined on basis elements by $$(a_1\otimes\ldots\otimes a_m)\times(b_1\otimes\ldots\otimes b_n)=(a_1\otimes\ldots\otimes a_m\otimes b_1\otimes\ldots\otimes b_n).$$

It is noted $(\mathfrak{A}\otimes_k\ldots\otimes_k\mathfrak{A})_{0\ factors}=\mathbf{k}$ by definition.

For e,f,g∈k−{0}, define the quaternion k-algebra $\mathbb{H}(\mathbf{k},e,f,g)$ to be $$\mathbb{H}(\mathbb{k},e,f,g)=\frac{T_{\mathbb{k}}(\mathbb{k}^3)}{\Theta(\mathbb{k},e,f,g)},$$

where, defining I=(1,0,0),J=(0,1,0),K=(0,0,1), $\Theta(\mathbf{k},e,f,g)$ is the two-sided ideal generated by $$ef+\otimes I$$

$$eg+J\otimes J$$

$$fg+K\otimes K$$

$$efg+I\otimes J\otimes K$$

The quaternion units $\{\pm1,\pm I,\pm J,\pm K\}$ form a non-abelian group $\mathcal{H}$of order 8 under multiplication. By expressing $\mathbf{k}$as $\{1,1',I,I',J,J',K,K'\}$, then the quaternions over any commutative field $\mathcal{H}$can be abstractly represented as the quotient $\mathbf{H}(\mathbf{k})=\mathbf{k}[\mathcal{H}]/\Theta$, where $\mathbf{k}[\mathcal{H}]$ is the group ring and $\Theta$ is the two-sided ideal generated by 1+1',I+I',J+J',K+K'.

There are many extensions $\mathbf{k}\supseteq\mathbf{R}$ which are fields. For example, the field of formal quotients $$\frac{a_0+a_1x+\ldots+a_nx^n}{b_0+b_1x+\ldots+b_mx^m},$$

$a_0, a_1, \ldots, a_n, b_0, b_1, \ldots, b_m\epsilon\mathbf{R}$. However, Frobenius' Theorem asserts that none of these can be finite-dimensional as vector spaces over $\mathbf{R}$.

Just as there are $S^+O(2)$ representations for the complex numbers, there are comparable representations for the quaternions. These are especially important because there are certain procedures, such as extracting the eigenstructure of quaternion matrices, which are nearly impossible except in these representations.

It is noted that an (n×n) complex matrix Q is called unitary if $QQ^*=Q^*Q=1$. $Q^*$ denotes the conjugate transpose also called the hermitian conjugate (which is sometimes denoted $Q^H$):

$$\begin{pmatrix} z_{11} & \cdots & z_{1n} \\ & \ddots & \iddots \\ \vdots & z_{ij} & \vdots \\ & \iddots & \ddots \\ z_{n1} & \cdots & z_{nn} \end{pmatrix}^* = \begin{pmatrix} z_{11}^* & \cdots & z_{n1}^* \\ & \ddots & \iddots \\ \vdots & z_{ij}^* & \vdots \\ & \iddots & \ddots \\ z_{1n}^* & \cdots & z_{nn}^* \end{pmatrix}.$$

It is noted when Q is real, $Q^*=Q^T$. The group of (n×n) unitary matrices is denoted U(n). Thus $O(n)\subseteq U(n)$.

As with the orthogonal matrices, a complex matrix Q is termed "extended unitary" if the more general rule $$QQ^*=Q^*Q=r\cdot1, r\epsilon\mathbf{R}$$

holds and denote the (n×n) extended unitary matrices by $^+U(n)$. So $^+O(n)\cup{}^+U(n)\subseteq{}^+U(n)$ and $^+U(n)-\{0\}$ is a group under multiplication.

A unitary matrix Q is special unitary if det(Q)=1 and analogously an extended unitary matrix Q is special extended unitary if $\det(Q)\geqq0$. The special extended unitary matrices are denoted $S^+U(n)$; thus, $(S^+O(n)\cup SU(n))\subseteq S^+U(n)$, and $S^+U(n)-\{0\}$ is a group under multiplication.

As with $S^+O(n)$, it is straight forward to calculate that $Q\epsilon S^+U(n)$ if and only if Q=0 or $(\det(Q)\epsilon\mathbf{R},\det(Q)>0$ and $$\frac{1}{\sqrt[n]{\det(Q)}}$$

$Q\epsilon SU(n)$). This implies that every $Q\epsilon S^+U(n)$ has a unique representation $Q=sU$, $s\epsilon\mathbf{R}, s\geqq0$, $U\epsilon SU(n)$ and conversely.

It can be shown that a (2×2) complex matrix Q is special extended unitary if and only if it is of the form:

$$Q=\begin{pmatrix} z_+ & z_- \\ -z_-^* & z_+^* \end{pmatrix}, z_+, z_-\in C.$$

Defining $$[\![ z_+ + z_- J ]\!] = \begin{pmatrix} z_+ & z_- \\ -z_-^* & z_+^* \end{pmatrix},$$

it can be shown, using the laws of quaternion arithmetic in the bicomplex representation, that [] converts all the algebraic operations in $\mathbf{H}$into matrix operations. []is called the $S^+U(2)$ representation.

Moreover, the $S^+U(2)$ representation sends conjugation to hermitian conjugation and the squared norm to the determinant:

$$[\![(z_+ + z_- J)^*]\!] = [\![z_+^* - z_- J]\!] = \begin{pmatrix} z_+^* & -z_- \\ z_-^* & z_+ \end{pmatrix} = \begin{pmatrix} z_+ & z_- \\ -z_-^* & z_+^* \end{pmatrix}^* = [\![z_+ + z_- J]\!]^*$$

$$\left|z_+ + z_- J\right|^2 = |z_+|^2 + |z_-|^2 = det\begin{pmatrix} z_+ & z_- \\ -z_-^* & z_+^* \end{pmatrix} = det[\![z_+ + z_- J]\!].$$

In particular, the unit 3-sphere $$S^3=\{(x_1,x_2,x_3,x_4)\epsilon\mathbf{R}^4; x_1^2+x_2^2+x_3^2+x_4^2=1\}\approx\{q\epsilon\mathbf{H}; |q|^2=1\}$$

is isomorphic to the spin group SU(2) by means of the representation [].

The unit quaternions $\{q\epsilon\mathbf{H}; |q|^2=1\}$ is denoted $\mathbf{U}\subseteq\mathbf{H}$. In terms of the (3+1) form of quaternions, the $S^+U(2)$ representation is $$[\![ a+bI+cJ+cK ]\!] = \begin{pmatrix} a+bi & c+di \\ -c+di & a-bi \end{pmatrix}.$$

Decomposing the matrix [a+bI+cJ+cK] yields $$[\![ a+bI+cJ+cK ]\!] = \begin{pmatrix} a+bi & c+di \\ -c+di & a-bi \end{pmatrix}$$

-continued $$= a\begin{pmatrix} 1 & 0 \\ 0 & 1 \end{pmatrix} + b\begin{pmatrix} i & 0 \\ 0 & -i \end{pmatrix} + c\begin{pmatrix} 0 & 1 \\ -1 & 0 \end{pmatrix} + d\begin{pmatrix} 0 & i \\ i & 0 \end{pmatrix}$$

and, thus, $$[\![1]\!] = \begin{pmatrix} 1 & 0 \\ 0 & 1 \end{pmatrix}, [\![I]\!] = \begin{pmatrix} i & 0 \\ 0 & -i \end{pmatrix},$$

$$[\![J]\!] = \begin{pmatrix} 0 & 1 \\ -1 & 0 \end{pmatrix}, [\![K]\!] = \begin{pmatrix} 0 & i \\ i & 0 \end{pmatrix}.$$

The above are denoted as the standard units of the $S^+U(2)$ representation.

It is also easy to extend the $S^+U(2)$ representation to m×n quaternion matrices component wise:

$$\left[\!\!\left[\begin{pmatrix} & \vdots & \\ \cdots & a_{ij} & \cdots \cdots \\ & \vdots & \end{pmatrix}\right]\!\!\right] = \begin{pmatrix} & \vdots & \\ \cdots & [\![a_{ij}]\!] & \cdots \cdots \\ & \vdots & \end{pmatrix}.$$

This representation will preserve all the additive and multiplicative properties of quaternion matrices.

Assuming $\hat{\alpha} \epsilon \mathbf{R}^3$ is a unit vector and $\theta \epsilon \mathbf{R}$ be an angle, then the quaternion is defined as follows:

$$u = u(\theta, \hat{\alpha}) = \cos\frac{\theta}{2} + \left(\sin\frac{\theta}{2}\right)\hat{\alpha}.$$

For all vectors $\vec{v} \epsilon \mathbf{R}^3$, the quaternion product $u\vec{v}u^*$ is also a vector and is the right-handed rotation of $\vec{v}$ about the axis $\hat{\alpha}$ by angle θ. It is noted $u(\theta,\hat{\alpha})$ is always a unit quaternion; i.e., $u(\theta,\hat{\alpha}) \epsilon \mathbf{U}$.

This result has found uses in, for example, computer animation and orbital mechanics because it reduces the work required to compound rotations: a series of rotations $(\theta_1,\hat{\alpha}_1), \ldots, (\theta_k,\hat{\alpha}_k)$ can be represented by the quaternion product $u(\theta_k,\hat{\alpha}_k) \ldots u(\theta_1,\hat{\alpha}_1)$ which is much more efficient to compute than the product of the associated rotation matrices. Moreover, by inverting the map $(\theta,\hat{\alpha}) \mapsto (\theta,\hat{\alpha})$ the resultant angle and axis of this series of rotations can be calculated:

$$(\theta_{net},\hat{\alpha}_{net}) = u^{-1}[u(\theta_k,\hat{\alpha}_k) \ldots u(\theta_1,\hat{\alpha}_1)],$$

which is simpler than computing the eigenstructure of the product rotation matrix.

If $q = a + \vec{v}$ is an arbitrary quaternion and $u \epsilon \mathbf{U}$ then $uqu^* = u(a + \vec{v})u^* = auu^* + u\vec{v}u^* = a + u\vec{v}u^*$ so that rotation by u leaves Sc(q) unchanged. In particular, when $q \epsilon \mathbf{R}$, $uqu^* = q$ so rotation leaves $\mathbf{R} \subseteq \mathbf{H}$ invariant. Thus $ulu^* = 1$.

Also $$u(q+r)u^* = uqu^* + uru^*$$

$$u(qr)u^* = u(q(u^*u)r)u^* = (uqu^*)(uru^*)$$

$$(uqu^* = r) \Leftrightarrow (q = u^*ru).$$

The conclusion is that the rotation map $q \mapsto (uqu^*)$ is an algebraic automorphism of Hi.e., a structure-preserving one-to-one correspondence.

Assuming $\vec{u}, \vec{v}$ are non-parallel vectors of the same length, then there is at least one rotation of $\mathbf{R}^3$ which sends $\vec{u}$ to $\vec{v}$. Any unit vector $\hat{\alpha}$ which lies on the plane of points which are equidistant from the tips of $\vec{u}, \vec{v}$ can be used as an axis for a rotation which sends $\vec{u}$ to $\vec{v}$.

As $\vec{u}$ is rotated around one of these axes, the tip of $\vec{u}$ moves in a circle which lies in the sphere centered at the origin and passing through the tips of $\vec{u}, \vec{v}$. Generally this is a small circle on this sphere. However, there are two unit vectors $\hat{\alpha}$ around which the tip of $\vec{u}$ moves in a great circle; namely $$\hat{\alpha} = \pm\frac{\vec{u} \times \vec{v}}{|\vec{u} \times \vec{v}|},$$

the unique unit vectors perpendicular to both $\vec{u}$ and $\vec{v}$.

When rotated around such $\hat{\alpha}$, the tip of $\vec{u}$ moves along either the longest or shortest path between the tips depending on the orientations. In either case, this path is an external of the length of the paths. Any unit vector around which $\vec{u}$ can be rotated into $\vec{v}$ along an external path is referred to as an "external unit vector." Clearly $\hat{\alpha}$ is an external unit vector, then so is $-\hat{\alpha}$.

When $\vec{u} = \vec{v} \neq \vec{0}$, the external vectors are $$\hat{\alpha} = \pm\frac{\vec{u}}{|\vec{u}|}$$

since any rotation fixing $\vec{u}$ must have the line containing $\vec{u}$ as an axis. When $\vec{u} = -\vec{v} \neq \vec{0}$, the external vectors are all unit vectors in the plane perpendicular to $\vec{u}$. When $\vec{u} = \vec{v} = \vec{0}$, the external vectors are all unit vectors.

Now, it is assumed that $\hat{\alpha},\hat{\beta},\hat{\gamma}$ and $\hat{\alpha}',\hat{\beta}',\hat{\gamma}'$ are two right-handed, orthonormal systems of vectors: $\hat{\alpha} \perp \hat{\beta}$, $|\hat{\alpha}| = |\hat{\beta}| = 1$, $\hat{\gamma} = \hat{\alpha} \times \hat{\beta}$ and similarly for $\hat{\alpha}',\hat{\beta}',\hat{\gamma}'$. To simplify the analysis, that it is further assumed that $\hat{\alpha},\hat{\alpha}'$ are not parallel and $\hat{\beta},\hat{\beta}'$ are not parallel.

As discussed above, all the rotations sending $\hat{\alpha}$ to $\hat{\alpha}'$ determine a plane and similarly for the rotations sending $\hat{\beta}$ to $\hat{\beta}'$. Assuming these planes are not the same, they will intersect in a line through the origin. There is then a unique rotation around this line (and only around this line) which will simultaneously send $\hat{\alpha}$ to $\hat{\alpha}'$ and $\hat{\beta}$ to $\hat{\beta}'$. Since $\hat{\gamma} = \hat{\alpha} \times \hat{\beta}$ and $\hat{\gamma}' = \hat{\alpha}' \times \hat{\alpha}'$, this rotation also sends $\hat{\gamma}$ to $\hat{\gamma}'$.

By carefully analyzing the various cases when parallelism occurs, the following can be shown:

Proposition 1 For any two right-handed, orthonormal systems of vectors $\hat{\alpha},\hat{\beta},\hat{\gamma}$ and $\hat{\alpha}',\hat{\beta}',\hat{\gamma}'$, there is a unit quaternion $u \epsilon \mathbf{U}$ such that $$\hat{\alpha}'=u\hat{\alpha}u^*$$

$$\hat{\beta}'=u\hat{\beta}u^*,$$

$$\hat{\gamma}'=u\hat{\alpha}u^*$$

Moreover, u is unique up to sign: ±u will both work.

The sign ambiguity is easy to understand:

$$u = u(\theta, \hat{\alpha}) = \cos\frac{\theta}{2} + \left(\sin\frac{\theta}{2}\right)$$

$\hat{\alpha}$ is the rotation around $\hat{\alpha}$ by angle θ while $$\begin{aligned} -u &= -\cos\frac{\theta}{2} - \left(\sin\frac{\theta}{2}\right)\hat{\alpha} \\ &= \cos\left(\frac{2\pi-\theta}{2}\right) + \sin\left(\frac{2\pi-\theta}{2}\right)(-\hat{\alpha}) \\ &= u((2\pi-\theta), -\hat{\alpha}) \end{aligned}$$

is the rotation around $-\hat{\alpha}$ by angle (2π−θ). However, these are geometrically identical operations.

Because of the automorphism properties, if u∈U and the following is defined $$I'=uIu^*$$

$$J'=uJu^*$$

$$K'=uKu^*$$

then the relations $$I^2=J^2=K^2=I'J'K'=-1$$

$$I'J'=K',J'K'=I',K'I'=J'$$

will hold. This means the new units I',J',K' are algebraically indistinguishable form the old units I,J,K.

Therefore, any right-handed, orthonormal system of unit vectors can function as the quaternion units.

As a result of this, neither the bicomplex nor the $S^+U(2)$ representations are unique. For example, it was mentioned previously that any of the maps $$(a+bi)\mapsto(a+bI)$$

$$(a+bi)\mapsto(a+bJ)$$

$$(a+bi)\mapsto(a+bK)$$

could be used to define a distinct embedding C⊆H hence induces a distinct bicomplex representation of H.

All of these arise by cyclically permuting the units: I,J,K→J,K,I→K,I,J which can be accomplished by the rotation quaternion $$u = \frac{1}{\sqrt{3}}(I + J + K).$$

In fact, there are exactly 24 different right-hand systems that can be selected from {±I,±J,±K}, any of which can function as a quaternion basis, and all of which are obtained by some rotation quaternion of the form $$u = \frac{1}{\sqrt{3}}(I \pm J \pm K).$$

In other words, if U∈SU(2), then $$\begin{aligned} [\![ a + bI + cJ + cK ]\!]_U = {} & a\begin{pmatrix} 1 & 0 \\ 0 & 1 \end{pmatrix} + b\left[U\begin{pmatrix} i & 0 \\ 0 & -i \end{pmatrix}U^*\right] + \\ & c\left[U\begin{pmatrix} 0 & 1 \\ -1 & 0 \end{pmatrix}U^*\right] + \\ & d\left(U\begin{pmatrix} 0 & i \\ i & 0 \end{pmatrix}U^*\right] \end{aligned}$$

is a valid $S^+U(2)$ representation.

This illustrates the additional richness of the quaternions over the complex numbers: the only non-trivial R-invariant automorphism of Cis complex conjugation but Hhas a distinct automorphism for each unit {±u}⊆H.[6]

Assuming a is an n×n matrix over C. a is called normal if it commutes with its conjugate: aa*=a*a. Important classes of normal matrices include the following:

Hermitian (or symmetric or self-adjoint): a*=a

Anti-hermitian (or anti-symmetric): a*=−a

Unitary (or orthogonal): $a^*=a^{-1}$

Non-negative: a=bb* for some b

Semi-positive: a is non-negative and a≠0

A projection: $a^2=a^*=a$

It is a classic result that any normal matrix a can be diagonalized by a unitary matrix; that is, there is a unitary matrix u and a diagonal matrix $$\lambda = \begin{pmatrix} \lambda_1 & & & \\ & \lambda_2 & & \\ & & \ddots & \\ & & & \lambda_n \end{pmatrix}$$

such that u*au=λ.

$\lambda_1, \lambda_2, \ldots, \lambda_n \in \mathbf{C}$ are the eigenvalues of a and the columns of u form an orthonormal basis for $\mathbf{C}^n$ with the inner product $$\langle \vec{x}, \vec{y} \rangle = \sum_v x_v y_v^*.$$

The standard normal classes can be characterized by the properties of $\lambda_1, \lambda_2, \ldots, \lambda_n$:

Hermitian⇔$\lambda_1, \lambda_2, \ldots, \lambda_n \in \mathbf{R}$

Anti-hermitian⇔

$$\frac{1}{i}\lambda_1, \frac{1}{i}\lambda_2, \ldots, \frac{1}{i}\lambda_n, \in R$$

Unitary⇔$|\lambda_1|=|\lambda_2|= \ldots =|\lambda_n|=1$

Non-negative⇔$\lambda_1, \lambda_2, \ldots, \lambda_n \in \mathbf{R}$ and $\lambda_1, \lambda_2, \ldots, \lambda_n \geqq 0$ Semi-positive⇔$\lambda_1, \lambda_2, \ldots, \lambda_n \in \mathbf{R}$ and for some ν, $\lambda_\nu>0$.

A projection$\Leftrightarrow\lambda_1, \lambda_2, \ldots, \lambda_n \in \{0,1\}$ In particular, it is noted that any real normal matrix $a \in \mathbf{R}^{n\times n}$ will generally have complex eigenvalues and eigenvectors. In the special case that a is symmetric ($a^T=a$), a can be diagonalized by a real orthogonal matrix and has real diagonal entries.

The first step in quaternion modeling is to generalize this result to H; i.e., to show that any normal quaternion matrix a can be diagonalized by a unitary quaternion matrix. In fact, it can be shown that the eigenvalues are in $\mathbf{C} \subseteq \mathbf{H}$. This latter fact is important because it means the characteristic polynomial $p_a(\lambda)=\det(\lambda 1-a)$ need not be discussed, which, as mentioned above, is badly behaved over H. This also implies that the same classification of the normal types based on the properties of $\lambda_1, \lambda_2, \ldots, \lambda_n \in \mathbf{C}$ works for quaternion matrices as well.

This can be regarded as the Fundamental Theorem of quaternions because it has so many important consequences. In particular, in the case n=1, this will yield the polar representation of a quaternion, which is the basis for quaternion spatial modeling.

As pointed out above, parts of standard linear algebra do not work over H. However, linear independence and the properties of span( ) in $\mathbf{H}^n$ work the same way as in $\mathbf{C}^n$ except that the left scalar multiplication needs to be distinguished from the right scalar multiplication. Because His a division ring, the following lemmas result:

Lemma 1 Let $\vec{w}, \vec{v}_1, \ldots, \vec{v}_l \in \mathbf{H}^n$ and suppose $\{\vec{v}_1, \ldots, \vec{v}_l\}$ is linearly independent but $\{\vec{w}, \vec{v}_1, \ldots, \vec{v}_l\}$ is linearly dependent, then $\vec{w}_k \in \mathrm{span}(\vec{v}_1, \ldots, \vec{v}_l)$.

Lemma 2 Let $\vec{w}_1, \ldots, \vec{w}_k, \vec{v}_1, \ldots, \vec{v}_l \in \mathbf{H}^n$ such that $\vec{w}_1, \ldots, \vec{w}_k \in \mathrm{span}(\vec{v}_1, \ldots, \vec{v}_l)$ and k>l, then $\{\vec{w}_1, \ldots, \vec{w}_k\}$ is linearly dependent.

These lemmas imply all the usual results concerning bases and dimension including the fact that any linearly independent set can be extended to a basis for $\mathbf{H}^n$.

The inner product yields:

$$\langle \vec{x}, \vec{y} \rangle = \left\langle \begin{pmatrix} x_1 \\ \vdots \\ x_n \end{pmatrix}, \begin{pmatrix} y_1 \\ \vdots \\ y_n \end{pmatrix} \right\rangle = \sum_{v=1}^{n} x_v y_v^*$$

which satisfies the usual properties of the inner product over $\mathbf{C}^n$ including $\langle \vec{x}, \vec{x} \rangle = 0 \Leftrightarrow (\vec{x}=0)$ and $\langle q\vec{x}, \vec{y} \rangle = q \cdot \langle \vec{x}, \vec{y} \rangle$, $q \in \mathbf{H}$. Perpendicularity is defined by $(\vec{x} \perp \vec{y}) \Leftrightarrow \langle \vec{x}, \vec{y} \rangle = 0$.

Lemma 3 (Projection Theorem for H) Let $\vec{v}_1, \ldots, v_l \in \mathbf{H}^n$, then for all $\vec{w} \in \mathbf{H}^n$, there exist $q_1, \ldots q_l \in \mathbf{H}$ and a unique $\vec{e} \in \mathbf{H}^n$ such that $\vec{w} q_1 \vec{v}_l + \ldots q_l \vec{v}_l + \vec{e}$ and $\vec{e} \perp v_1, \ldots, \vec{v}_l$. If $\{\vec{v}_1, \ldots, \vec{v}_l\}$ is linearly independent, then $q_1, \ldots q_l$ are also unique.

Using the Projection Theorem, it can be shown that $\mathbf{H}^n$ has an orthonormal basis and, in fact, any orthonormal set $\{\vec{v}_1, \ldots, \vec{v}_l\}$ can be extended to an orthonormal basis.

The matrix u of change-of-basis to any orthonormal set is unitary and thus the matrix g of any linear operator $$H^n \xrightarrow{G} H^n$$

is transformed to ugu* by the basis change.

Let $$a = \begin{pmatrix} a & b \\ c & d \end{pmatrix}$$

be a 2×2 matrix over C. Define the matrix $$a^\circ = \begin{pmatrix} d^* & -c^* \\ -b^* & a^* \end{pmatrix}$$

and suppose $$a\begin{pmatrix} u \\ v \end{pmatrix} = \begin{pmatrix} x \\ y \end{pmatrix},$$

$$\text{then } a^\circ\begin{pmatrix} -v^* \\ u^* \end{pmatrix} = \begin{pmatrix} d^* & -c^* \\ -b^* & a^* \end{pmatrix}\begin{pmatrix} -v^* \\ u^* \end{pmatrix} = \begin{pmatrix} -(cu+dv)^* \\ (au+bv)^* \end{pmatrix} = \begin{pmatrix} -y^* \\ x^* \end{pmatrix}.$$

Next it is noted that for any $$\begin{pmatrix} z_+ & z_- \\ -z_-^* & z_+^* \end{pmatrix} \in S^+U(2), \begin{pmatrix} z_+ & z_- \\ -z_-^* & z_+^* \end{pmatrix}^0 = \begin{pmatrix} (z_+^*)^* & -(-z_-^*)^* \\ -(z_-)^* & (z_+)^* \end{pmatrix} = \begin{pmatrix} z_+ & z_- \\ -z_-^* & z_+^* \end{pmatrix}.$$

Thus, the following lemma results:

Lemma 4 Let $q \in \mathbf{H}$ and $$\begin{pmatrix} u \\ v \end{pmatrix}, \begin{pmatrix} x \\ y \end{pmatrix} \in C^2$$

such that $$[\![ q ]\!]\begin{pmatrix} u \\ v \end{pmatrix} = \begin{pmatrix} x \\ y \end{pmatrix},$$

then $$[\![ q ]\!]\begin{pmatrix} -v^* \\ u^* \end{pmatrix} = \begin{pmatrix} -y^* \\ x^* \end{pmatrix}.$$

It is noted that this result is independent of which form of [] is used. However, the next result requires selecting a specific form:

Proposition 2 It is assumed that a be an n×n quaternion matrix and $\vec{w} \in \mathbf{C}^{2n} - \{\vec{0}\}$ is an eigenvector of the standard representation [a] with eigenvalue $\lambda \in \mathbf{C}$, $\vec{w}$ can be written in the form $$\vec{w} = \begin{pmatrix} u_1 \\ v_1 \\ \vdots \\ u_n \\ v_n \end{pmatrix}.$$

Also, $\lambda \in \mathbf{C}$ can be identified with $\lambda \in \mathbf{H}$ by replacing $i \in \mathbf{C}$ by $I \in \mathbf{H}$; then $$a\begin{pmatrix} u_1 - Jv_1 \\ \vdots \\ u_n - Jv_n \end{pmatrix} = \begin{pmatrix} u_1 - Jv_1 \\ \vdots \\ u_n - Jv_n \end{pmatrix} \cdot \lambda.$$

Writing [a] and $$\vec{w} = \begin{pmatrix} u_1 \\ v_1 \\ \vdots \\ u_n \\ v_n \end{pmatrix}$$

in blocks as $$[\![ a ]\!] = \begin{pmatrix} & & \\ & [\![ a_{kl} ]\!] & \\ & & \end{pmatrix} \text{ and } \vec{w} = \begin{pmatrix} \begin{matrix} u_1 \\ v_1 \end{matrix} \\ \\ \begin{matrix} u_n \\ v_n \end{matrix} \end{pmatrix},$$

the equation $a\vec{w} = \vec{w}\lambda$ is seen to be $$\sum_{l=1}^{n} [\![ a_{kl} ]\!] \begin{pmatrix} u_l \\ v_l \end{pmatrix} = \begin{pmatrix} u_k \\ v_k \end{pmatrix} \lambda = \begin{pmatrix} u_k \lambda \\ v_k \lambda \end{pmatrix},$$

k=1, . . . , n.

By Lem. 3, $$\sum_{l=1}^{n} [\![ a_{kl} ]\!] \begin{pmatrix} -v_l^* \\ u_l^* \end{pmatrix} = \begin{pmatrix} -v_k^* \lambda^* \\ u_k^* \lambda^* \end{pmatrix} = \begin{pmatrix} -v_k^* \\ u_k^* \end{pmatrix} \cdot \lambda^*, k = 1, \cdots, n$$

$$\Rightarrow \sum_{l=1}^{n} [\![ a_{kl} ]\!] \begin{pmatrix} u_l & -v_l^* \\ v_l & u_l^* \end{pmatrix} = \begin{pmatrix} u_k & -v_k^* \\ v_k & u_k^* \end{pmatrix} \cdot \begin{pmatrix} \lambda & 0 \\ 0 & \lambda^* \end{pmatrix}, k = 1, \cdots, n.$$

However, $$\left.\begin{pmatrix} u_l & -v_l^* \\ v_l & u_l^* \end{pmatrix} = \begin{pmatrix} u_l & (-v_l^*) \\ -(-v_l^*)^* & u_l^* \end{pmatrix} = [\![ u_l + (-v_l^*)J ]\!] \right] = [\![ u_l - Jv_l ]\!] \text{ and}$$

$$\begin{pmatrix} \lambda & 0 \\ 0 & \lambda^* \end{pmatrix} = [\![ \lambda + 0J ]\!] = [\![ \lambda ]\!]$$

in the standard representation.

Therefore $$\sum_{l=1}^{n} a_{kl}(u_l - Jv_l) = (u_k - Jv_k) \cdot \lambda \text{ in}$$

$$H \Rightarrow a\begin{pmatrix} u_1 - Jv_1 \\ \vdots \\ u_n - Jv_n \end{pmatrix} = \begin{pmatrix} u_1 - Jv_1 \\ \vdots \\ u_n - Jv_n \end{pmatrix} \cdot \lambda \text{ in } H^{\underline{w}}.$$

It is noted that this proposition shows that if column vectors are used to represent $\mathbf{H}^n$ then "eigenvalue" must be taken to mean "right eigenvalue".

Proposition 3 (The Fundamental Theorem): Let a be an n×n normal matrix over $\mathbf{H}$, then there exists an n×n unitary matrix u over $\mathbf{H}$ and a diagonal matrix $$\lambda = \begin{pmatrix} \lambda_1 & & & \\ & \lambda_2 & & \\ & & \ddots & \\ & & & \lambda_n \end{pmatrix}$$

with $\lambda_1, \lambda_2, \ldots, \lambda_n \in \mathbf{C}$ such that u*au=λ. λ is unique up to permutations of the diagonal coefficients.

Let a be normal. Since every matrix over $\mathbf{C}^{2n}$ has an eigenvector, Prop. 2 implies that a has an eigenvector $y \in \mathbf{H}^n - \{\vec{0}\}$ with eigenvalue $\lambda_1 \in \mathbf{C}$. By the corollaries to the Projection Theorem, $\vec{\gamma}$ can be extended to an orthogonal basis for $\mathbf{H}^n$. In this basis, a becomes $$u_1^* a u_1 = \begin{pmatrix} \lambda_1 & q_2 \ \cdots \ q_n \\ \begin{matrix} 0 \\ \vdots \\ 0 \end{matrix} & a' \end{pmatrix},$$

where $u_1$ is unitary. This matrix is also normal and since $$\left(\begin{array}{c|ccc} \lambda_1 & q_2 & \cdots & q_n \\ \hline 0 & & & \\ \vdots & & a' & \\ 0 & & & \end{array}\right)^* \cdot \left(\begin{array}{c|ccc} \lambda_1 & q_2 & \cdots & q_n \\ \hline 0 & & & \\ \vdots & & a' & \\ 0 & & & \end{array}\right) = \left(\begin{array}{c|ccc} \lambda_1^* & 0 & \cdots & 0 \\ \hline q_2^* & & & \\ \vdots & & (a')^* & \\ q_n^* & & & \end{array}\right) \cdot \left(\begin{array}{c|ccc} \lambda_1 & q_2 & \cdots & q_n \\ \hline 0 & & & \\ \vdots & & a' & \\ 0 & & & \end{array}\right)$$

$$= \left(\begin{array}{c|ccc} |\lambda_1|^2 & \lambda_1^* q_2 & \cdots & \lambda_1^* q_n \\ \hline q_2^* \lambda_1 & & & \\ \vdots & & b & \\ q_n^* \lambda_1 & & & \end{array}\right),$$

for some b, and $$\left(\begin{array}{c|ccc} \lambda_1 & q_2 & \cdots & q_n \\ \hline 0 & & & \\ \vdots & & a' & \\ 0 & & & \end{array}\right) \cdot \left(\begin{array}{c|ccc} \lambda_1 & q_2 & \cdots & q_n \\ \hline 0 & & & \\ \vdots & & a' & \\ 0 & & & \end{array}\right)^* = \left(\begin{array}{c|ccc} \lambda_1 & q_2 & \cdots & q_n \\ \hline 0 & & & \\ \vdots & & a' & \\ 0 & & & \end{array}\right) \cdot \left(\begin{array}{c|ccc} \lambda_1^* & 0 & \cdots & 0 \\ \hline q_2^* & & & \\ \vdots & & (a')^* & \\ q_n^* & & & \end{array}\right)$$

$$= \left(\begin{array}{c|ccc} |\lambda_1|^2 + \sum_{v=2}^{n} |q_v|^2 & r_2 & \cdots & r_n \\ \hline r_2^* & & & \\ \vdots & & a'(a')^* & \\ r_n^* & & & \end{array}\right),$$

for some $r_2, \ldots, r_n$, by equating the corner coefficients, the following is obtained:

$$\sum_{v=2}^{n} |q_v|^2 = 0 \Rightarrow (q_2 = \cdots = q_n = 0). \text{ Thus } u_1^* a u_1 = \left(\begin{array}{c|ccc} \lambda_1 & 0 & \cdots & 0 \\ \hline 0 & & & \\ \vdots & & a' & \\ 0 & & & \end{array}\right)$$

and a' is normal.

Continuing in the same way on a', yields, $$u^* a u = (u_n \cdots u_1) A (u_n \cdots u_1)^*$$

$$= u_n \cdots u_1 a u_1^* \cdots u_n^*$$

-continued $$= \left(\begin{array}{c|ccc} \lambda_1 & 0 & \cdots & 0 \\ \hline 0 & \ddots & & \vdots \\ \vdots & & \ddots & 0 \\ 0 & \cdots & 0 & \lambda_n \end{array}\right)$$

with $u = u_n \ldots u_1$ unitary and $\lambda_1, \lambda_2, \ldots, \lambda_n \in \mathbf{C}$.

The Fundamental Theorem not only establishes the existence of the diagonalization but, when combined with Prop. 1, yields a method for constructing it.

With respect to eigenvalue degeneracy, an (n×n) matrix over a commutative division ring (i.e., a field) can have at most n eigenvalues because its characteristic polynomial can have at most n roots. However, this is no longer true over non-commutative division rings as the following consequence of the Fundamental Theorem shows.

First, let a be an (n×n) normal quaternion matrix and define Eig(a) to be the eigenvalues of a in H. C is identified with the subfield of H by regarding i=I in the usual manner. A set of complex numbers $\lambda_1, \lambda_2, \ldots, \lambda_m \in \mathbf{C} \cap \mathrm{Eig}(a)$ is defined to be "eigen-generators" for a if they satisfy the following: (i) $\lambda_1, \lambda_2, \ldots, \lambda_m$ are all distinct; (ii) no pair $\lambda_k, \lambda_l$, are complex conjugates of one another; and (iii) the list $\lambda_1, \lambda_2, \ldots, \lambda_m \in \mathbf{C} \cap \mathrm{Eig}(a)$ cannot be extended without violating (i) or (ii).

Proposition 4 Let a be an (n×n) normal quaternion matrix, then at least one set of eigen-generators $\lambda_1, \lambda_2, \ldots, \lambda_m \in \mathbf{C} \cap \mathrm{Eig}(a)$ with $1 \leqq m \leqq n$ exists. If $\lambda_1, \lambda_2, \ldots, \lambda_m \in \mathbf{C} \cap \mathrm{Eig}(a)$ is one such, then a quaternion $\mu \in \mathbf{H}$ is an eigenvalue of a if and only if for some $1 \leqq k \leqq m$, $\mu = \mathrm{Re}(\lambda_k) + \mathrm{Im}(\lambda_k)\hat{u}$, where $\hat{u} \in \mathbf{R}^3$ with $|\hat{u}| = 1$. Moreover, k is unique and if $\mu \in \mathbf{R}$ then $\hat{u}$ is unique as well.

Corollary 1 If μ is a quaternion eigenvalue of a, then so is $\mu^*$ and $q\mu q^{-1}$ for any $q \in \mathbf{H} - \{0\}$.

Corollary 2 If $\lambda_1, \lambda_2, \ldots, \lambda_m \in \mathbf{C} \cap \mathrm{Eig}(a)$, $\lambda_1', \lambda_2', \ldots, \lambda_{m'} \in \mathbf{C} \cap \mathrm{Eig}(a)$ are two sets of eigen-generators then m'=m, $1 \leqq m \leqq n$, and $\lambda_1', \lambda_2', \ldots, \lambda_m'$ is a permutation of $\lambda_1^{(\pm *)}, \lambda_2^{(\pm *)}, \ldots, \lambda_m^{(\pm *)}$, where $\lambda^{(\pm *)}$ denotes exactly one of $\lambda, \lambda^*$.

Corollary 3 There is at least one, but no more than n, distinct elements of $\mathbf{C} \cap \mathrm{Eig}(a)$.

Turning now to a discussion of Hermitian-regular rings and compact projections, it is assumed that X is a left A-module, and $Y, Z \subseteq X$ are submodules. The smallest submodule of X which includes both Y and Z is denoted Y+Z. It is evident that $Y+Z = \{y+z;\ y \in Y, z \in Z\}$.

An important special case of this construction is when the following two conditions hold:

(i) $Y \cap Z = \{0\}$ (ii) X=Y+Z.

In this case, every $x \in X$ has a unique decomposition of the form $x = y+z, y \in Y, z \in Z$. The existence is clear by (ii). As for uniqueness, if $y+z = x = y'+z'$, then $y-y' = z'-z$ and since Y,Z are submodules, then $y-y' \in Y$ and $z'-z \in Z$, so $y-y' = z'-z \in Y \cap Z = \{0\}$. Therefore, y=y' and z=z' as stated.

When (i) and (ii) hold, then $X = Y \oplus Z$ in which X denotes the "(internal) direct sum" of Y,Z.

Now assuming A is a *-algebra and X has a definite inner product on it, a stronger condition on the pair Y, Z is considered; namely:

(i') $Y \perp Z$ by which is meant every $y \in Y$ is perpendicular to every $x \in X$. Clearly (i') implies (i) since if $x \in Y \cap Z$ with $Y \perp Z$, then $x \perp x$ so $x=0$ since the inner product is definite.

When (i') and (ii) hold, then $X=Y \oplus^{\perp} Z$, which is referred to as an "orthogonal decomposition or projection" of X onto Y (or Z).

Thus, $(X=Y \oplus^{\perp} Z) \Rightarrow (X=Y \oplus Z)$, but the converse usually does not hold.

For any submodule Y, the following is defined:

$$Y^{\perp}=\{y \in Y;(\forall x \in X)(y \perp x)\}.$$

Clearly $Y^{\perp}$ is a submodule of X and $Y \perp Y^{\perp}$. Subsequently, some conditions under which $X=Y \oplus^{\perp}(Y^{\perp})$ (i.e., when $X=Y+Y^{\perp}$) are examined, as these conditions are key to the Levinson algorithm. First, the converse is examined.

Proposition 5 Let $X=Y \oplus_{\perp} Z$, then (i) $Z=Y^{\perp}$ and $Y=Z^{\perp}$ (ii) $Y^{\perp\perp}==Y$ and $Z^{\perp\perp}=Z$.

As discussed above, it is not generally the case that $X=Y+Y^{\perp}$ where $Y \subseteq X$ are modules with a definite inner product. There are well-understood stood situations, however, when this does hold so that $X=Y \oplus Y^{\perp}$. For example, in the case of an Ror Cvector space which has a metric completeness property like a Banach or Hilbert space, $X=Y \oplus Y^{\perp}$ will hold for every subspace Y which is topologically closed. In particular, this will hold for every finite-dimensional subspace Y because finite-dimensional subspaces are always topologically closed. This latter finite result, in fact, holds for any division ring D, not merely D=R, C. Any finite-dimensional subspace $Y \subseteq X$ of a D-vector space has an orthogonal basis and from that orthogonal basis an orthogonal projection $X=Y \oplus Y^{\perp}$ may be constructed.

Such finite orthogonal projections are required for the Levinson algorithm because they correspond precisely to minimum power residuals in finite-lag, multi-channel linear prediction. This leads to the following definition:

Let A be a *-algebra. An A-module X is said to "admit compact projections" if for every f.g. submodule $Y \subseteq X$, the following exists: $X=Y \oplus Y^{\perp}$.

It is noted that if X admits compact projections, then every submodule $Y \subseteq X$ which is of the form $Y=Z^{\perp}$ for some f.g. submodule Z will also satisfy $X=Y \oplus Y^{\perp}$ because by Prop. 5, $Y^{\perp}=Z^{\perp\perp}=Z$ so $Y \oplus Y^{\perp}=Z^{\perp} \oplus Z=X$. However it is not generally the case that if $Y \subseteq X$ satisfies $Y^{\perp}$ is f.g, then $X=Y \oplus Y^{\perp}$ because for this result, it is required that $Y=Y^{\perp\perp}$, which generally does not hold.

Further, A itself can be defined to admit compact projections if every A-module X with definite inner product admits compact projections. For example, the results above show that every division ring admits compact projections.

The next step is to find a generalization of division rings for which this property continues to hold.

A pseudo-inverse of a scalar $a \in A$ is a $a' \in A$ such that $aa'a \in a$. A ring A is called regular if every element has a pseudo-inverse. Clearly if $a \in A$ has an inverse $a^{-1}$ then $a^{-1}$ is a pseudo-inverse: $aa^{-1}a=1a=a$. However, many scalars have pseudo-inverses that are not units; for example, for any $b \in A$, $0b0=0$ so b is a pseudo-inverse of 0. This also shows that pseudo-inverses are not unique.

Regular rings can be easily constructed. For example, if $\{D_v; v \in N\}$ is a set of division rings, then $$\prod_v D_v$$

is a regular ring because a pseudo-inverse of $$(a_v) \in \prod_v D_v$$

can be defined by the rule $$a'_v = \begin{cases} a_v^{-1}, & \text{if } a_v \neq 0 \\ 0, & \text{if } a_v = 0 \end{cases}.$$ [2]

However, regular rings are too special; generalization of this concept is needed. It is assumed that A is a *-algebra, in which $\mathfrak{N}$is a subset of A, wherein A is defined to be $\mathfrak{N}$-regular if every $a \in \mathfrak{N}$ has a pseudo-inverse.

Normal-regular, hermitian-regular, and semi-positive-regular rings are of particular interest.

An "idempotent" is an $e \in A$ for which $e^2=e$. It is noted that a projection, as previously defined, is an hermitian idempotent. A is "indecomposable" if 0,1 are the only idempotents in A.

Proposition 6:

(i) Let A be a definite *-algebra. If $A^{+} \subseteq \text{unit}(A)$ then A is a division ring. If, in addition, $A^{+} \subseteq Z(A)$, then A is normal.

(ii) An indecomposable, definite, semi-positive-regular *-algebra is a division ring. If, in addition, $A^{+} \subseteq Z(A)$, then A is normal.

Corollary VII.1 Let A be a symmetric algebra, then k(A) is a field and A is a normal division ring which is a k(A)*-algebra.

Proposition 7 (The Projection Theorem) Every hermitian regular ring admits compact projections. The following formulation can be used to calculate the projection coefficients. It is assumed that A be a hermitian regular ring and X a left A-module with definite inner product <,>, and that $Y \subseteq X$ be a finitely generated submodule. Accordingly, the following needs to be proved: $X=Y+Y^{\perp}$.

If $Y=\{0\}$ then $Y^{\perp}=X$ so the result is trivial. So assume $Y=\text{span}_A(y_1, \ldots, y_n)$, $n \geqq 1$. The result may be proved by induction on n, as follows.

For n=1:

Let $x \in X$. Since ${}^2|y_1| \in A$ is hermitian and A is hermitian regular, ${}^2|y_1|$ has a pseudo-inverse $({}^2|y_1|)'$. Define $$e=x-\langle x,y_1\rangle({}^2|y_1|)'\cdot y_1,$$

then $x \in \text{span}_A(y_1)+\text{span}_A(e)$ so it is sufficient to show that $y_1 \perp e$. $\langle e,y_1\rangle=\langle x,y_1\rangle-\langle x,y_1\rangle\cdot{}^2|y_1|'\cdot{}^2|y_1|=\langle x,y_1\rangle\cdot p=\langle x,p^*\cdot y_1\rangle$, where $p=1-{}^2|y_1|'\cdot{}^2|y_1|$. So it is sufficient to show that $p^*\cdot y_1=0$.

$$\begin{aligned} {}^2|p^*\cdot y_1| &= \langle p^*\cdot y_1, p^*\cdot y_1\rangle \\ &= p^*\cdot{}^2|y_1|\cdot p \end{aligned}$$

-continued $$
\begin{aligned}
&= p^* \cdot {}^2|y_1| \cdot \left(1 - {}^2|y_1|' \cdot {}^2|y_1|\right) \\
&= p^* \cdot \left({}^2|y_1| - {}^2|y_1| \cdot {}^2|y_1|' \cdot {}^2|y_1|\right) \\
&= p^* \cdot \left({}^2|y_1| - {}^2|y_1|\right) \\
&= p^* \cdot 0 \\
&= 0.
\end{aligned}
$$

<,> is definite so $p^* \cdot y_1 = 0$.

Let $n \geqq 2$ and assume the result holds for n:

Let $Y = \mathrm{span}_A(y_1, \ldots, y_n, y_{n+1})$ and $x \in X$. By the inductive hypothesis applied twice, scalars $a_1, \ldots a_n, b_1, \ldots b_n \in A$ and $e, f \in X$ are found such that $$x = a_1 y_1 + \ldots + a_n y_n + e, e \perp y_1, \ldots, y_n$$

$$y_{n+1} = b_1 y_1 + \ldots + b_n y_n + f, f \perp y_1, \ldots, y_n$$

Also by the n=1 case, $$e = af + \bar{e}, \bar{e} \perp f.$$

Then $$
\begin{aligned}
x &= a_1 y_1 + \cdots + a_n y_n + e \\
&= a_1 y_1 + \cdots + a_n y_n + \alpha f + \bar{e} \\
&= a_1 y_1 + \cdots + a_n y_n + \alpha(y_{n+1} - b_1 y_1 - \cdots - b_n y_n) + \bar{e} \\
&= (a_1 - \alpha b_1) y_1 + \cdots + (a_n - \alpha b_n) y_n + \alpha y_{n+1} + \bar{e}
\end{aligned}
$$

so it sufficient to show $\bar{e} \perp y_1, \ldots, y_n, y_{n+1}$.

Both $e, f \perp y_1, \ldots, y_n$ so $\bar{e} = (e - \alpha f) \perp y_1, \ldots, y_n$.

But, then $\langle y_{n+1}, \bar{e} \rangle = b_1 \langle y_1, \bar{e} \rangle + \ldots + b_n \langle y_n, \bar{e} \rangle + \langle f, \bar{e} \rangle = 0$ by definition of $\bar{e}$ so $\bar{e} \perp y_{n+1}$ also.

By induction, the result holds for all $n \geqq 1$.

Prop. VII.3.b (Constructive Form of the Projection Theorem) Let A be a hermitian regular ring and X a left A-module with definite inner product <,>. Let $y_1, y_2, \ldots \in X$ be a (possibly infinite) sequence of elements. To project $x \in X$ onto $y_1, y_2, \ldots$, the following is noted.

For n=0: $x = 0 + e^{(0)}$, where $e^{(0)} = x$.

$$\text{For } n = 1: \quad x = a_1^{(1)} \cdot y_1 + e^{(1)} \text{ where } \begin{cases} a_1^{(1)} = \left(\langle x, y_1 \rangle \; {}^2|y_1|'\right) \\ e^{(1)} = x - a_1^{(1)} \cdot y_1 \end{cases}$$

and ${}^2|y_1|'$ is a pseudo-inverse of the hermitian element ${}^2|y_1|$.

For n+1, $n \geqq 1$, the following projections onto n generators result:

(i) Project x onto $y_1, y_2, \ldots, y_n$:

$$x - a_1^{(n)} \cdot y_1 + \ldots a_n^{(n)} \cdot y_n + e^{(n)}, e^{(n)} \perp y_1, \ldots, y_n.$$

(ii) Project $y_{n+1}$ onto $y_1, y_2, \ldots, y_n$:

$$y_{n+1} = b_1^{(n)} \cdot y_1 + \ldots b_n^{(n)} \cdot y_n + f^{(n)}, f^{(n)} \perp y_1, \ldots, y_n.$$

(iii) Project $e^{(n)}$ onto $f^{(n)}$ using the n=1 case:

$$e^{(n)} = \alpha^{(n)} \cdot f^{(n)} + \bar{e}^{(n)}, \bar{e}^{(n)} \perp f^{(n)}.$$

(iv) Then $$\begin{pmatrix} a_1^{(n+1)} \\ \vdots \\ a_n^{(n+1)} \\ a_{n+1}^{(n+1)} \end{pmatrix} = \begin{pmatrix} a_1^{(n)} \\ \vdots \\ a_n^{(n)} \\ 0 \end{pmatrix} - \alpha^{(n)} \cdot \begin{pmatrix} b_1^{(n)} \\ \vdots \\ b_n^{(n)} \\ -1 \end{pmatrix}.$$

$$e^{(n+1)} = \bar{e}^{(n)}$$

It is noted that if A is a field and every finite subset of $y_1, y_2, \ldots \in X$ is linearly independent, then the coefficients $a_1^{(n)}(\vec{y}, x), \ldots, a_n^{(n)}(\vec{y}, x) \in A$ are unique. However, generally this will not hold; only the decomposition $x = [a_1^{(n)}(\vec{y}, x) \cdot y_1 + \ldots + a_n^{(n)}(\vec{y}, x) \cdot y_n] + e^{(n)}(\vec{y}, x)$ itself is unique.

It is apparent that the class of $\mathfrak{N}$-regular rings is closed under direct products and quotients. However, it is difficult in general to infer $\mathfrak{N}$-regularity for the important class of matrix algebras $\mathcal{M}(n,n,A)$ from general assumptions concerning A.[3] One method that applies to (3+1)-dimensional modeling is singular decomposition.

Singular decompositions are an abstract form of the singular value decompositions of ordinary matrix theory. Let $\mathfrak{M} \subseteq A$. Let $a \in A$. A singular decomposition of a over $\mathfrak{M}$ is an identity $a = ubu^{-1}$ where $b \in \mathfrak{M}$ and $\mathbf{3}u \in \mathrm{unit}(A)$.

Lemma 5 Let A be $\mathfrak{M}$-regular where $\mathfrak{M} \subseteq A$. Let $\mathfrak{N} \subseteq A$ and suppose every $a \in \mathfrak{N}$ has a singular decomposition over $\mathfrak{M}$, then A is $\mathfrak{N}$-regular.

Proposition 9. The matrix algebras $\mathcal{M}(n,n,\mathbf{C})$ and $\mathbf{H}(n,n,\mathbf{H})$ are normal regular; hence they are hermitian regular. The matrix algebra $\mathcal{M}(n,n,\mathbf{R})$ is symmetric regular. Hence it is hermitian regular.

Corollary 5 The matrix algebras $\mathcal{M}(n,n,D)$ for $D = \mathbf{R}, \mathbf{C}, \mathbf{H}$ admit compact projections.

Linear prediction is really a collection of general results of linear algebra. A discussion of the mapping of signals to vectors in such a way that the algorithm may be applied to optimal prediction is more fully described below.

According to the Yule-Walker Equations:

Let A be a *-algebra and $R \in \mathcal{M}((M+1),(M+1),A)$, $M \geqq 0$. R is a toeplitz matrix if it has the form $$R = \begin{pmatrix} r_0 & r_1 & r_2 & \cdots & \cdots & r_M \\ r_{-1} & r_0 & r_1 & \ddots & & \\ r_{-2} & \ddots & \ddots & \ddots & \ddots & \\ \vdots & \ddots & \ddots & \ddots & \ddots & r_2 \\ r_{-M+1} & & \ddots & \ddots & \ddots & r_1 \\ r_{-M} & r_{-M+1} & \cdots & r_{-2} & r_{-1} & r_0 \end{pmatrix};$$

that is, using 0-based indexing, $(\forall 0 \leqq k,l \leqq M)(R_{k,l}=r_{l-k})$. An hermitian toeplitz matrix must thus have the form $$R=\begin{pmatrix} r_0 & r_1 & r_2 & \cdots & \cdots & r_M \\ r_1^* & r_0 & r_1 & \ddots & & \\ r_2^* & \ddots & \ddots & \ddots & \ddots & \\ \vdots & \ddots & \ddots & \ddots & \ddots & r_2 \\ r_{M-1}^* & & \ddots & \ddots & \ddots & r_1 \\ r_M^* & r_{M-1}^* & \cdots & r_2^* & r_1^* & r_0 \end{pmatrix}$$

so $r_{-k}=r_k^*$. It is noted, in particular, that $r_0$ must be an hermitian scalar.

When R is toeplitz and no confusion will result, the following notation is used: $(R_{k,l}=R_{l-k})$. M is called the "order" of R.

Let R be a fixed hermitian toeplitz matrix of order M over scalars A. Yule-Walker parameters for R are scalars $$a_1, \ldots, a_M, ({}^2\sigma), b_0, \ldots, b_{M-1}, ({}^2\tau) \epsilon A$$

satisfying the Yule-Walker equations $$\left\{\begin{matrix} \sum_{m=0}^{M} a_m R_{p-m} = {}^2\sigma \cdot \delta_p \\ \sum_{m=0}^{M} b_m R_{p-m} = {}^2\tau \cdot \delta_{M-p} \end{matrix}\right\} \quad p=0, \cdots, M,$$

where $a_0=b_M=1$ is defined, and δ is the Kronecker delta function $$\delta_p = \begin{cases} 1; & p=0 \\ 0; & p \neq 0 \end{cases}.$$

It is noted that no claim concerning existence or uniqueness of $a_1, \ldots, a_M, ({}^2\sigma), b_0, \ldots, b_{M-1}, ({}^2\tau) \epsilon A$ is implied. Also the notation ${}^2\sigma, {}^2\tau$ does not imply that these parameters are hermitian (although there are important cases in which the hermitian property holds).

The scalars $a_1, \ldots, a_M, {}^2\tau$ are called the "forward" parameters and $b_0, \ldots, b_{M-1}, {}^2\tau$ are the "backwards" parameters. The definitions $a_0=b_M=1$ always is made without further comment.

When M=0, the Yule-Walker parameters are simply ${}^2\sigma, {}^2\tau$ and the Yule-Walker equations reduce to ${}^2\sigma=a_0R_0=b_0R_0={}^2\tau$. This is one case in which it can be concluded that ${}^2\sigma, {}^2\tau$ are hermitian scalars.

Lemma 6 (The γ Lemma) Let $a_1, \ldots, a_M, ({}^2\sigma), b_0, \ldots, b_{M-1}, ({}^2\tau) \epsilon A$ be Yule-Walker parameters for R. Define $$\gamma = \sum_{m=0}^{M} \sum_{k=0}^{M} a_m R_{k-m+1} b_k^*.$$

Then, $$\gamma = \begin{cases} \sum_{m=0}^{M} a_m R_{M-m+1} \\ \sum_{m=0}^{M} R_{m+1} b_m^* \end{cases}.$$

Let X be a left A-module with inner product. A (possibly infinite) sequence $x_0, x_1, \ldots, x_M, \ldots \epsilon X$ is called toeplitz if $(\forall m \geqq n \geqq 0)$ the inner product $\langle x_n, x_m \rangle$ depends only on the difference m−n.

For such a sequence, the autocorrelation sequence $R_m=R_m(x_0, x_1, \ldots) \epsilon A$, $m \epsilon \mathbf{Z}$ can be defined by $$R_m = \begin{cases} \langle x_0, x_m \rangle; & m \geq 0 \\ \langle x_{|m|}, x_0 \rangle; & m < 0 \end{cases}$$

and, then:

$$\begin{cases} (\forall m \in Z)(R_{-m} = R_m^*) \\ (\forall m, n \in Z)(R_{m-n} = \langle x_n, x_m \rangle) \end{cases}.$$

This means that if $R^{(M)}=R^{(M)}(x_0, x_1, \ldots) \epsilon \mathcal{M}((M+1),(M+1),A)$, $M \geqq 0$ is defined by the rule $$R_{n,m}^{(M)}=R_{m-n}, 0 \leqq m,n \leqq M,$$

then $R^{(M)}$ is an hermitian toeplitz matrix of order M over A.

An autocorrelation matrix (of order M) can be defined to be an hermitian toeplitz matrix $R^{(M)}$ which derives from a toeplitz sequence $x_0, x_1, \ldots, x_M, \ldots \epsilon X$ as above.

Thus, $R^{(M)}$ is just the Gram matrix of the vectors $x_0, x_1, \ldots, x_M$.

Now assume further that the inner product on X is definite and that X admits compact projections.

Accordingly, for any $M \geqq 0$, $X=\text{span}_A(x_0, \ldots, x_M) \oplus^{\perp} (\text{span}_A(x_0, \ldots, x_M))^{\perp}$ since X admits compact projections; and so there are scalars $a_1^{(M)}, \ldots, a, ({}^2\sigma^{(M)}), b_0^{(M)}, \ldots, b_{M-1}^{(M)}, ({}^2\tau^{(M)}) \epsilon A$ and unique vectors $e^{(M)}, f^{(M)} \epsilon X$ satisfying the following:

$$\begin{cases} x_0 = -\sum_{m=1}^{M} a_m^{(M)} x_m + e^{(M)}, \; e^{(M)} \perp x_1, \cdots, x_M \\ x_M = -\sum_{m=0}^{M-1} b_m^{(M)} x_m + f^{(M)}, \; f^{(M)} \perp x_0, \cdots, x_{M-1}. \\ {}^2\sigma^{(M)} = |e^{(M)}|, \; {}^2\tau^{(M)} = {}^2|f^{(M)}| \end{cases}$$

$a_1^{(M)}, \ldots, a_M^{(M)}, ({}^2\sigma^{(M)}), b_0^{(M)}, \ldots, b_{M-1}^{(M)}, ({}^2\tau^{(M)}) \epsilon A$ is referred to as "Levinson parameters" of order M and the defining relations the "Levinson relations (or the Levinson equations)."

It is noted that since $e^{(M)}, f^{(M)}$ are unique, so are ${}^2\sigma^{(M)}, {}^2\tau^{(M)}$. The coefficients $a_1^{(M)}, \ldots, a_M^{(M)}, b_0^{(M)}, \ldots, b_{M-1}^{(M)}$ are unique if $x_0, x_1, \ldots, x_M$ are linearly independent over A but this can only happen in the single-channel situation so that $a_1^{(M)}, \ldots, a_M^{(M)}, b_0^{(M)}, \ldots, b^{M-1(M)}$ is regarded as non-unique unless explicitly stated. However, the vectors $$\left[-\sum_{m=1}^{M} a_m^{(M)} x_m\right] \in X, \left[-\sum_{m=0}^{M-1} b_m^{(M)} x_m\right] \in X$$

are always unique.

Defining $a_0^{(M)}=b_M^{(M)}=1$, the Levinson equations can be written $$\begin{cases} \sum_{m=0}^{M} a_m^{(M)} x_m = e^{(M)},\ e^{(M)} \perp x_1, \cdots, x_M \\ \sum_{m=0}^{M} b_m^{(M)} x_m = f^{(M)},\ f^{(M)} \perp x_0, \cdots, x_{M-1} \end{cases}.$$

For M=0, the Levinson parameters are just ${}^2\sigma^{(M)}, {}^2\tau^{(M)}$ and the Levinson relations are $$\begin{cases} e^{(0)} = a_0^{(0)} x_0 = x_0 = b_0^{(0)} x_0 = f^{(0)} \\ {}^2\sigma^{(0)} = {}^2|x_0| = {}^2\tau^{(0)} \end{cases}.$$

The scalars $a_1^{(M)}, \ldots, a_M^{(M)}$ are called the forward filter, $b_0, \ldots, b_{M-1}$, the backwards filter, $e^{(M)}, f^{(M)}$ the forwards and backwards residuals, and ${}^2|e^{(M)}|, {}^2|f^{(M)}|$ the forwards and backwards errors. The definitions $a_0=b_M=1$ will always be made without further comment.

Lemma 7 Let $x_0, x_1, \ldots, x_M, \ldots \epsilon X$ be a toeplitz sequence in the A-module X, where X has a definite inner product and admits compact projections, then any set of Levinson parameters of order M for $x_0, x_1, \ldots, x_M, \ldots$ are Yule-Walker parameters for the autocorrelation matrix $R^{(M)}$ $(x_0, x_1, \ldots, x_M, \ldots)$ and conversely.

Hence the scalars ${}^2\sigma, {}^2\tau \epsilon A$ of sets of Yule-Walker parameters for $R^{(M)}$ are unique and hermitian.

Corollary 6 (The Backshift Lemma) Let $a_1^{(M)}, \ldots, a_M^{(M)}, ({}^2\sigma^{(M)}), b_0^{(M)}, \ldots, b_{M-1}^{(M)}, ({}^2\tau^{(M)}) \epsilon A$ be Levinson parameters for the toeplitz sequence $x_0, x_1, \ldots, x_M, x_{M+1}, \ldots \epsilon X$. Defining $$\breve{f}^{(M)} = \sum_{m=0}^{M} b_m^{(M)} x_{m+1},,$$

then $\breve{f}^{(M)} \perp x_1, \ldots, x_M$ and ${}^2\tau^{(M)} = {}^2|\breve{f}^{(M)}|$.

The Levinson Algorithm is provides a fast way of extending Levinson parameters $a_1^{(M)}, \ldots, a_M^{(M)}, ({}^2\sigma^{(M)}), b_0^{(M)}, \ldots, b_{M-1}^{(M)}, ({}^2\tau^{(M)}) \epsilon A$ of order M for a toeplitz sequence $x_0, x_1, \ldots, x_M, \ldots \epsilon X$ to Levinson parameters $a_1^{(M+1)}, \ldots, a_{M-1}^{(M+1)}, ({}^2\sigma^{(M+1)}), b_0^{(M+1)}, \ldots, b_M^{(M+1)}, ({}^2\tau^{(M+1)}) \epsilon A$ of order (M+1).

This can be derived by using Lem. 7 to reduce the problem to the Yule-Walker equations, which can be put into the matrix form:

$$\begin{pmatrix} 1 & a_1^{(M)} & \cdots & a_M^{(M)} \\ b_0^{(M)} & \cdots & b_{M-1}^{(M)} & 1 \end{pmatrix} R^{(M)} = \begin{pmatrix} {}^2\sigma^{(M)} & 0 & \cdots & 0 \\ 0 & \cdots & 0 & {}^2\tau^{(M)} \end{pmatrix}.$$

Moreover, the hermitian, toeplitz form of the autocorrelation matrices implies that $R^{(M+1)}$ can be blocked as both $$R^{(M+1)} = \left(\begin{array}{c|c} R^{(M)} \rightarrow \ \downarrow & \begin{matrix} \boxed{R_{M+1}} \\ R_M \\ \vdots \\ R_1 \end{matrix} \\ \hline \boxed{R_{M+1}^*} \quad R_M^* \quad \cdots \quad R_1^* & R_0 \end{array}\right)$$

and $$R^{(M+1)} = \left(\begin{array}{c|c} R_0 & R_1 \quad \cdots \quad R_M \quad \boxed{R_{M+1}} \\ \hline \begin{matrix} R_1^* \\ \vdots \\ R_M^* \\ \boxed{R_{M+1}^*} \end{matrix} & R^{(M)} \rightarrow \ \downarrow \end{array}\right).$$

This also shows how the coefficient $R_{M+1}$ adds the new information while passing from order to (M+1).

Simple manipulations on these matrix relations easily yield recursive formulae expressing $a_1^{(M+1)}, \ldots, a_{M+1}^{(M+1)}, ({}^2\sigma_{(M+1)}), b_0^{(M+1)}, \ldots, b_M^{(M+1)}, ({}^2\tau^{(M+1)})$ in terms of $a_1^{(M)}, \ldots, a_M^{(M)}, ({}^2\sigma^{(M)}), b_0^{(M)}, \ldots, b_{M-1}^{(M)}, ({}^2\tau^{(M)})$ and $R_{M+1}$ with the proviso that ${}^2\sigma^{(M)}$ and ${}^2\tau^{(M)}$ are invertible in A. This is the algorithmic meaning of non-singularity although in many cases it can be directly related to the non-singularity of the matrices $R^{(M)}$.

A good illustration of the general commutative, non-singular theory are the Szegö polynomials:

Let μ be a real measure on the unit circle, let A=C, and X be the complex functions whose singularities are contained in the interior of the unit circle (i.e., the z-transforms of causal sequences). For $f, g \epsilon X$ define $$\langle f, g \rangle_\mu = \int_{-\pi}^{\pi} f(e^{i\omega}) g(e^{i\omega})^* d\mu(e^{i\omega}).$$

${}^2|f|_\mu=0$ is clearly equivalent to $f=0$ a.e.(μ) and there are a variety of assumptions that can be made about μ to ensure that, in this case, $f=0$ identically. For example, if the set of points of discontinuity $\Delta(\mu)=\{\omega;\ \mu\{\omega\}>0\}$ form a set of uniqueness for the trigonometric polynomials. Assuming that such a condition holds, $\langle -,- \rangle_\mu$ is a definite inner product on X.

The sequence $x_0, x_1, \ldots, x_M, \ldots \epsilon X$ is defined simply as $z^0, z^{-1}, z^{-2}, \ldots$ which is toeplitz because $$\langle z^{-n}, z^{-m} \rangle_\mu = \int_{-\pi}^{\pi} e^{-in\omega} (e^{-im\omega})^* d\mu(\omega) = \int_{-\pi}^{\pi} e^{i(m-n)\omega} d\mu(\omega)$$

depends only on (m−n).

Once again, there are various analytic assumptions which can be made about μ which will imply that the autocorrelation matrices $R_\mu^{(\mathcal{M})} \in \mathcal{M}((M+1),(M+1),\mathbf{C})$ are non-singular. In such cases ${}^2\sigma^{(\mathcal{M})}, {}^2\tau^{(\mathcal{M})} \neq 0$; i.e., ${}^2\sigma^{(\mathcal{M})}$ and ${}^2\tau^{(\mathcal{M})}$ are invertible in C.

Therefore, with appropriate analytic assumptions, the M-th order Szegö polynomials for the measure μ can be well-defined as the Levinson residuals $e^{\mu(\mathcal{M})}(z), f_\mu^{(\mathcal{M})}(z)$ of the sequence $z^0, z^{-1}, z^{-2}, \ldots$.

$e_\mu^{(\mathcal{M})}(z), f_\mu^{(\mathcal{M})}(z)$ are M-th order polynomials (in $z^{-1}$) which are perpendicular to $z^{-1}, z^{-2}, \ldots, z^{-\mathcal{M}}$ and 1, $z^{-1}, \ldots, z^{-\mathcal{M}+1}$ respectively in the μ-inner product. These orthogonality properties make then extremely useful for certain signal processing tasks.

Once non-commutative scalars are introduced, for example, by passing to a multi-channel situation, the previous method breaks down for the reasons previously discussed: (i) multi-channel correlations introduce unremovable degeneracies in the autocorrelation matrices making them highly non-singular; (ii) the notion of "non-singularity" itself becomes problematic. For example, the determinant function may no longer test for invertibility.

The proximate effect of these problems is that at some stage M of the Levinson algorithm ${}^2\sigma^{(\mathcal{M})}$ or ${}^2\tau^{(\mathcal{M})}$ may be non-invertible in A. As pointed out previously, in the single-channel situation with scalars in a division ring such as R,C,H this means ${}^2\sigma^{(\mathcal{M})}=0$ or ${}^2\tau^{(\mathcal{M})}=0$, which can be regarded as meaning simply that the channel is highly correlated with its past M values. However, in other cases, such as multi-channel prediction with scalars $A=\mathcal{M}(K,K,\mathbf{R})$, $\mathcal{M}(K,K,\mathbf{C}), \mathcal{M}(K,K,\mathbf{H})$, $K \geqq 2$ the non-invertibility of ${}^2\sigma^{(\mathcal{M})}$ or ${}^2\tau^{(\mathcal{M})}$ is a result of a complex interaction between signals, channels, algebra, and geometry.

Thus, instead of looking for inverses to ${}^2\sigma^{(\mathcal{M})}, {}^2\tau^{(\mathcal{M})}$, the present invention, according to one embodiment, is based on pseudo-inverses, and, in fact, on the more general theory of compact projections.

According the present invention provides a non-commutative, singular Levinson algorithm, as discussed below. Let A be an hermitian-regular ring and X a left A-module with definite inner product, then by the Projection Theorem (Prop. 7), X admits compact projections so the Levinson parameters exist. For all $M \geqq 0$, let $a_1^{(\mathcal{M})}, \ldots, a_{\mathcal{M}}^{(\mathcal{M})}, ({}^2\sigma^{(\mathcal{M})}), b_0^{(\mathcal{M})}, \ldots, b_{\mathcal{M}-1}^{(\mathcal{M})}, ({}^2\tau^{(\mathcal{M})}) \in A$ be Levinson parameters of order M for a toeplitz sequence $x_0, x_1, \ldots, x_{\mathcal{M}}, \ldots \in X$.

The constructive form of the Projection Theorem (Prop. VII.3.b) shows how to calculate the forward parameters $a_1^{(\mathcal{M})}, \ldots, a_{\mathcal{M}}^{(\mathcal{M})}, ({}^2\sigma^{(\mathcal{M})})$ inductively in four steps:

(i) Project $x_0$ onto $x_1, \ldots, x_{\mathcal{M}}$.

But by definition, $$x_0 = \left(-\sum_{m=1}^{M} a_m^{(M)} x_m\right) + e^{(M)}$$

is this projection.

(ii) Project $x_{\mathcal{M}+1}$ onto $x_1, \ldots, x_{\mathcal{M}}$.

By definition, $$x_M = \left(-\sum_{m=0}^{M-1} b_m^{(M)} x_m\right) + f^{(M)}$$

is the projection of $x_{\mathcal{M}}$ onto $x_0, \ldots, x_{\mathcal{M}-1}$ but by the Backshift Lemma, $$x_{M+1} = \left(-\sum_{m=0}^{M-1} b_m^{(M)} x_{m+1}\right) + \breve{f}^{(M)} = \left(-\sum_{m=1}^{M} b_{m-1}^{(M)} x_m\right) + \breve{f}^{(M)}$$

is a projection of $x_{\mathcal{M}+1}$ onto $x_1, \ldots, x_{\mathcal{M}}$, with ${}^2\tau^{(\mathcal{M})} = {}^2|\breve{f}^{(\mathcal{M})}|$.

(iii) Project $e^{(\mathcal{M})}$ onto $\breve{f}^{(\mathcal{M})}$ using a pseudo-inverse of ${}^2|\breve{f}^{(\mathcal{M})}|$. It is noted that such a pseudo-inverse exits since ${}^2|\breve{f}^{(\mathcal{M})}|$ is hermitian and A is hermitian-regular:

$$e^{(\mathcal{M})} = \alpha^{(\mathcal{M})} \breve{f}^{(\mathcal{M})} + \bar{e}^{(\mathcal{M})}, (\bar{e}^{(\mathcal{M})} \perp \breve{f}^{(\mathcal{M})})$$

$$\alpha^{(\mathcal{M})} = \langle e^{(\mathcal{M})}, \breve{f}^{(\mathcal{M})} \rangle \cdot {}^2|\breve{f}^{(\mathcal{M})}|' = \langle e^{(\mathcal{M})}, \breve{f}^{(\mathcal{M})} \rangle \cdot ({}^2\tau^{(\mathcal{M})})' = \gamma^{(\mathcal{M})} \cdot ({}^2\tau^{(\mathcal{M})})',$$

where $\gamma^{(\mathcal{M})} = \langle e^{(\mathcal{M})}, \breve{f}^{(\mathcal{M})} \rangle$.

(iv) Then, $$\begin{cases} \begin{pmatrix} (-a_1^{(M+1)}) \\ \vdots \\ (-a_M^{(M+1)}) \\ (-a_{M+1}^{(M+1)}) \end{pmatrix} = \begin{pmatrix} (-a_1^{(M)}) \\ \vdots \\ (-a_M^{(M)}) \\ 0 \end{pmatrix} - \alpha^{(M)} \cdot \begin{pmatrix} (-b_0^{(M)}) \\ \vdots \\ (-b_{M-1}^{(M)}) \\ -1 \end{pmatrix} \Rightarrow \\ (e^{(M+1)} = \bar{e}^{(M)}) \Rightarrow ({}^2\sigma^{(M+1)} = {}^2|\bar{e}^{(M)}|) \end{cases}$$

$$\begin{cases} \begin{pmatrix} a_0^{(M+1)} \\ a_1^{(M+1)} \\ \vdots \\ a_M^{(M+1)} \\ a_{M+1}^{(M+1)} \end{pmatrix} = \begin{pmatrix} a_0^{(M)} \\ a_1^{(M)} \\ \vdots \\ a_M^{(M)} \\ a_{M+1}^{(M)} \end{pmatrix} - \alpha^{(M)} \cdot \begin{pmatrix} b_{-1}^{(M)} \\ b_0^{(M)} \\ \vdots \\ b_{M-1}^{(M)} \\ b_M^{(M)} \end{pmatrix} \\ {}^2\sigma^{(M+1)} = {}^2|\bar{e}^{(M)}| \end{cases}$$

by canceling the signs and defining $$\begin{cases} a_0^{(M)} = a_0^{(M+1)} = b_M^{(M)} = b_{M+1}^{(M+1)} = 1 \\ a_{M+1}^{(M)} = b_{-1}^{(M)} = 0 \end{cases}.$$

The same basic reasoning can be applied to obtain the backwards parameters of the projection of $x_{\mathcal{M}+1}$ onto $x_0, \ldots, x_{(\mathcal{M}+1)-1} = x_{\mathcal{M}}$, However, by the Backshift Lemma, $$x_{M+1} = \left(-\sum_{m=0}^{M-1} b_m^{(M)} x_{m+1}\right) + \breve{f}^{(M)} = \left(-\sum_{m=1}^{M} b_{m-1}^{(M)} x_m\right) + \breve{f}^{(M)}$$

is a projection onto $x_1, \ldots, x_{\mathcal{M}}$. So the generators $x_1, \ldots, x_{\mathcal{M}}$ to $x_0, x_1, \ldots, x_{\mathcal{M}}$ are enlarged:

(i) Project $x_{\mathcal{M}+1}$ onto $x_1, \ldots, x_{\mathcal{M}}$.

By the above, $$x_{M+1} = \left(-\sum_{m=1}^{M} b_{m-1}^{(M)} x_{m+1}\right) + \breve{f}^{(M)}$$

is this projection.

(ii) Project $x_0$ onto $x_1, \ldots, x_M$:

$$x_0 = \left(-\sum_{m=1}^{M} a_m^{(M)} x_m\right) + e^{(M)}$$

(iii) Project $\breve{f}^{(M)}$ onto $e^{(M)}$ using a pseudo-inverse of ${}^2|e^{(M)}|$:

$$\breve{f}^{(M)} = \beta^{(M)} e^{(M)} + \breve{\bar{f}}^{(M)}, (\breve{\bar{f}}^{(M)} \perp e^{(M)})$$

$$\beta^{(M)} = \langle \breve{f}^{(M)}, e^{(M)} \rangle {}^2 \cdot |e^{(M)}|' = \langle \breve{f}^{(M)}, e^{(M)} \rangle \cdot ({}^2\tau^{(M)})' = (\gamma^{(M)})^* \cdot ({}^2\tau^{(M)})',$$

where $\gamma^{(M)} = \langle e^{(M)}, \breve{f}^{(M)} \rangle$.

(iv) Then $$\begin{cases} \begin{pmatrix} (-b_1^{(M+1)}) \\ \vdots \\ (-b_M^{(M+1)}) \\ (-b_0^{(M+1)}) \end{pmatrix} = \begin{pmatrix} (-b_0^{(M)}) \\ \vdots \\ (-b_{M-1}^{(M)}) \\ 0 \end{pmatrix} - \beta^{(M)} \cdot \begin{pmatrix} (-a_1^{(M)}) \\ \vdots \\ (-a_M^{(M)}) \\ -1 \end{pmatrix} \\ \left(f^{(M+1)} = \breve{\bar{f}}^{(M)}\right) \Rightarrow \left({}^2\tau^{(M+1)} = {}^2|\breve{\bar{f}}^{(M)}|\right) \end{cases}$$

$$\Rightarrow \begin{cases} \begin{pmatrix} b_0^{(M+1)} \\ b_1^{(M+1)} \\ \vdots \\ b_{M-1}^{(M+1)} \\ b_{M+1}^{(M+1)} \end{pmatrix} = \begin{pmatrix} b_{-1}^{(M)} \\ b_1^{(M)} \\ \vdots \\ b_{M-1}^{(M)} \\ b_M^{(M)} \end{pmatrix} - \beta^{(M)} \cdot \begin{pmatrix} a_0^{(M)} \\ a_1^{(M)} \\ \vdots \\ a_M^{(M)} \\ a_{M+1}^{(M)} \end{pmatrix}, \\ {}^2\tau^{(M+1)} = {}^2|\breve{\bar{f}}^{(M)}| \end{cases}$$

again by canceling the signs and defining $$\begin{cases} a_0^{(M)} = a_0^{(M+1)} = b_M^{(M)} = b_{M+1}^{(M+1)} = 1 \\ a_{M+1}^{(M)} = b_{-1}^{(M)} = 0 \end{cases}.$$

These equations can be summarized as:

$$\begin{cases} \begin{cases} a_m^{(M+1)} = a_m^{(M)} - \alpha^{(M)} \cdot b_{m-1}^{(M)} \\ b_m^{(M+1)} = b_{m-1}^{(M)} - \beta^{(M)} \cdot a_m^{(M)} \end{cases} m = 0, \ldots, M+1 \\ {}^2\sigma^{(M+1)} = {}^2|\bar{e}^{(M)}| \\ {}^2\tau^{(M+1)} = {}^2|\breve{\bar{f}}^{(M)}| \end{cases},$$

where $$\begin{cases} \begin{cases} e^{(M)} = \alpha^{(M)} \breve{f}^{(M)} + \bar{e}^{(M)}, \left(\bar{e}^{(M)} \perp \breve{f}^{(M)}\right) \\ \alpha^{(M)} = \gamma^{(M)} ({}^2\tau^{(M)})' \end{cases} \\ \begin{cases} \breve{f}^{(M)} = \beta^{(M)} e^{(M)} + \breve{\bar{f}}^{(M)}, \left(\breve{\bar{f}}^{(M)} \perp \breve{f}^{(M)}\right). \\ \beta^{(M)} = (\gamma^{(M)})^* ({}^2\sigma^{(M)})' \end{cases} \\ \gamma^{(M)} = \left\langle e^{(M)}, \breve{f}^{(M)} \right\rangle \end{cases}$$

Thus, $\bar{e}^{(M)}, \breve{\bar{f}}^{(M)}$ can be eliminated by analyzing ${}^2\sigma^{(M+1)}$, ${}^2\tau^{(M+1)}, \gamma^{(M)}$.

Applying $\langle -, e^{(M)} \rangle$ to $e^{(M)} = \alpha^{(M)} \breve{f}^{(M)} + \bar{e}^{(M)}$ yields:

$$\begin{aligned} {}^2\sigma^{(M)} &= {}^2|e^{(M)}| = \alpha^{(M)} \left\langle \breve{f}^{(M)}, e^{(M)} \right\rangle + \langle \bar{e}^{(M)}, e^{(M)} \rangle \\ &= \alpha^{(M)} (\gamma^{(M)})^* + \langle e^{(M+1)}, e^{(M)} \rangle \end{aligned} \tag{0.1}$$

since $e^{(M+1)} = \bar{e}^{(M)}$ by definition.

Applying $\langle -, e^{(M)} \rangle$ to $\breve{f}^{(M)} = \beta^{(M)} e^{(M)} + \breve{\bar{f}}^{(M)}$ yields:

$$(\gamma^{(M)})^* = \langle \breve{f}^{(M)}, e^{(M)} \rangle = \beta^{(M)2} |e^{(M)}| + \langle \breve{\bar{f}}^{(M)}, e^{(M)} \rangle = \beta^{(M)2} \sigma^{(M)} \tag{0.2}$$

since $\breve{\bar{f}}^{(M)} \perp e^{(M)}$ by definition of $\breve{\bar{f}}^{(M)}$.

Applying $\langle e^{(M+1)}, - \rangle$ to $e^{(M)} = \alpha^{(M)} \breve{f}^{(M)} + \bar{e}^{(M)}$ yields:

$$\begin{aligned} \langle e^{(M+1)}, e^{(M)} \rangle &= \alpha^{(M)} \left\langle e^{(M+1)}, \breve{f}^{(M)} \right\rangle + \langle e^{(M+1)}, \bar{e}^{(M)} \rangle \\ &= {}^2|e^{(M+1)}| = {}^2\sigma^{(M+1)} \end{aligned} \tag{0.3}$$

since $e^{(M+1)} = \bar{e}^{(M)}$ and $\bar{e}^{(M)} \perp \breve{f}^{(M)}$ by definition of $\bar{e}^{(M)}$.

Substituting (0.1), (0.2) into (0.3) yields:

$${}^2\sigma^{(M)} = \alpha^{(M)} \beta^{(M)2} \sigma^{(M)} + {}^2\sigma^{(M+1)}$$

$$\Rightarrow {}^2\sigma^{(M+1)} = (1 - \alpha^{(M)} \beta^{(M)}) \cdot {}^2\sigma^{(M)*}$$

A similar argument shows $${}^2\tau^{(M+1)} = (1 - \beta^{(M)} \alpha^{(M)}) \cdot {}^2\tau^{(M)}.$$

Now $\gamma^{(M)} = \langle e^{(M)}, \breve{f}^{(M)} \rangle$ by definition so using the two projection equations for $e^{(M)}, \breve{f}^{(M)}$ gives $$\gamma^{(M)} = \left\langle \sum_{m=0}^{M} a_m^{(M)} x_m, \sum_{k=0}^{M} b_k^{(M)} x_{k+1} \right\rangle =$$

-continued $$\sum_{m=0}^{M}\sum_{k=0}^{M} a_m^{(M)}\langle x_m, x_{k+1}\rangle b_k^{(M)*} = \sum_{m=0}^{M}\sum_{k=0}^{M} a_m^{(M)} R_{k-m+1} b_k^{(M)*}.$$

However, the γ Lemma, Lem. 6, implies that this expression can be computed in either of the forms $$\gamma^{(M)} = \begin{cases} \sum_{m=0}^{M} a_m^{(M)} R_{M-m+1} \\ \sum_{m=0}^{M} R_{m+1}(b_m^{(M)})^* \end{cases};$$

in which the first form can be arbitrarily chosen.

Theorem 1 (The Hermitian-regular Levinson Algorithm) Let A be an hermitian-regular ring and X a left A-module with definite inner product. Let $x_0, \ldots, x_M, \ldots \in X$ be a toeplitz sequence and $R_0, \ldots, R_M, \ldots \in A$ its autocorrelation sequence.

Define $$\begin{cases} a_0^{(0)} = b_0^{(0)} = 1 \\ {}^2\sigma^{(0)} = {}^2\tau^{(0)} = R_0 \end{cases}.$$

For $M \geqq 1$, where $a_1^{(M)}, \ldots, a_M^{(M)}, {}^2\sigma^{(M)}, b_0^{(M)}, \ldots, b_{M-1}^{(M)}, {}^2\tau^{(M)} \in A$ with ${}^2\tau^{(M)}, {}^2\sigma^{(M)}$ hermitian are given, define $$\begin{cases} a_0^{(M)} = b_M^{(M)} = a_0^{(M+1)} = 1 \\ a_{M+1}^{(M)} = b_{-1}^{(M)} = 0 \end{cases}$$

and $$\begin{cases} \gamma^{(M)} = \sum_{m=0}^{M} a_m^{(M)} R_{M-m+1} \\ \alpha^{(M)} = \gamma^{(M)} \cdot ({}^2\tau^{(M)})' \\ \beta^{(M)} = \gamma^{(M)*} \cdot ({}^2\sigma^{(M)})' \end{cases},$$

where $(-)'$ denotes a pseudo-inverse.

Finally, define $$\begin{cases} \begin{cases} a_m^{(M+1)} = a_m^{(M)} - \alpha^{(M)} \cdot b_{m-1}^{(M)} \\ b_m^{(M+1)} = b_{m-1}^{(M)} - \beta^{(M)} \cdot a_m^{(M)} \end{cases} m = 0, \ldots, M+1 \\ \begin{cases} {}^2\sigma^{(M+1)} = (1 - \alpha^{(M)}\beta^{(M)})^2 \sigma^{(M)} \\ {}^2\tau^{(M+1)} = (1 - \beta^{(M)}\alpha^{(M)})^2 \tau^{(M)} \end{cases} \end{cases}.$$

Then for all $M \geqq 0$, $a_1^{(M)}, \ldots, a_M^{(M)}, {}^2\sigma^{(M)}, b_0^{(M)}, \ldots, b_{M-1}^{(M)}, {}^2\tau^{(M)}$ are Levinson parameters for $x_0, \ldots, x_M, \ldots$.

It is noted that unlike non-singular forms of the algorithm, the residuals for singularity need not be tested and the increasing of the order M need not be stopped. Of course, in practice, the residuals is examined. For example, if ${}^2\sigma^{(M)} = {}^2\tau^{(M)} = 0$ then at any order N>M, thus the following can be chosen:

$$\begin{cases} a_m^{(N)} = a_m^{(M)}, m \leq M \\ a_m^{(N)} = 0, m > M \\ {}^2\sigma^{(N)} = 0 \end{cases}$$

and similarly for the backwards parameters.

More generally, if the eigenstructure of the residuals can be calculated then the dimensions of A and X can be reduced for later stages by passing to principal axes corresponding to invertible eigenvalues. However, there are tremendous conceptual and practical advantages to this approach because these reductions are not required.

In addressing the special cases of the Hermitian-singular Levinson Algorithm, the following corollary results:

Corollary 6 Let A be a symmetric algebra and $x_0, \ldots, x_M, \ldots \in X$ a toeplitz sequence in a left A-module X with definite inner product.

(i) Then the Levinson algorithm applies and, moreover, for every $M \geqq 0$, the following can be chosen:

$$\begin{cases} \beta^{(M)} = (\alpha^{(M)})^* \\ {}^2\sigma^{(M)} = {}^2\tau^{(M)} \end{cases}.$$

(ii) If, in addition, A is commutative, then the following can be chosen:

$$b_m^{(M)} = (a_{M-m}^{(M)})^*, m = 0, \ldots, M.$$

Thus, in this case, the backwards parameters do not need to be independently computed.

Cor. 6.i applies, for example, to single-channel prediction over Hand Cor. 6.ii to single-channel prediction over C.

With respect to multi-channel four-dimensional Linear Prediction Theorem, Corollary 7 is stated.

Corollary 7 The Levinson algorithm applies to any $\mathcal{M}$(K,K,D)-module X with definite inner product for D=R,C,H. In particular, the algorithm applies to any X=$\mathcal{M}$(K,L,D) with inner product ⟨x,y⟩=xy*.

Returning to the problem of modeling space curves, the present invention regards it as axiomatic that the points of a space curve must have a scale attached to them, a scale which may vary along the curve. This is because a space curve may wander globally throughout a spatial manifold.

There are several ways of extending a space curve $$I \xrightarrow{X} \mathbb{R}^3$$

to homogeneous coordinates $$I \xrightarrow{X} \mathbb{R}^3 \times \mathbb{R}.$$

One approach is to ignore the scale entirely by setting the scale coordinate σ=0. Another natural choice is have a uniform scale σ=1. However, it can be noted that these constant scales do not remain constant as 4-dimensional processing proceeds. As a result, there needs to be a good geometric interpretation for these scale changes.

The two major models used are characterized as either timelike or spacelike. The timelike model uses homogeneous coordinates ($\Delta x, \Delta y, \Delta z, \Delta t$). For data sampled at a uniform rate, $\Delta t$=constant so this is the uniform model above. However, there is no requirement of uniform sampling. It is noted that over the length of the curve, these homogeneous vectors can be added, maintaining a clear geometric interpretation:

$$\sum_i (\Delta x_i, \Delta y_i, \Delta z_i, \Delta t_i) = (\Delta x_{total}, \Delta y_{total}, \Delta z_{total}, \Delta t_{total}).$$

This is in distinction to the "velocities," which are the projective versions of the homogeneous points:

$$\vec{v}_i = \left(\frac{\Delta x_i}{\Delta t_i}, \frac{\Delta y_i}{\Delta t_i}, \frac{\Delta z_i}{\Delta t_i}\right)$$

which cannot be added along the curve without the scale $\Delta t_i$.

The spacelike model uses the arc length $\Delta s = \sqrt{(\Delta x)^2+(\Delta y)^2+(\Delta z)^2}$ as the scale. As with time the homogeneous coordinates are vectorial:

$$\sum_i (\Delta x_i, \Delta y_i, \Delta z_i, \Delta s_i) = (\Delta x_{total}, \Delta y_{total}, \Delta z_{total}, \Delta s_{total}).$$

The corresponding projective construct is the unit tangent vector:

$$\hat{T} = \left(\frac{\Delta x}{\Delta s}, \frac{\Delta y}{\Delta s}, \frac{\Delta z}{\Delta s}\right).$$

It is noted that $$|\hat{T}|^2 = \frac{\Delta x^2 + \Delta y^2 + \Delta z^2}{\Delta s^2} = 1.$$

$\hat{T}$ is (approximately) tangent to the space curve at the given point; i.e., parallel to the velocity $\vec{v}$. However, unlike $\vec{v}$, $\hat{T}$ is always of length 1 so all information concerning the speed $$v = \frac{\Delta s}{\Delta t}$$

of traversal of the curve is absent. In relativistic terms, the spacelike model is locally simultaneous.

Rather than a fault, the time-independence of the spacelike coordinates ($\Delta x, \Delta y, \Delta z, \Delta s$) is precisely the desired characteristic in certain situations, especially in gait modeling. For example, it is well-known from speech analysis that a single speaker does not speak the same phonemes at the same rates in different contexts. This is referred to as "time warping" and is a major difficulty in applying ordinary frequency-based modeling, which assume a constant rate of time flow, to speech. There are many semi-heuristic algorithms which have been developed to unwarp time in speech analysis. It is to be expected that the same phenomenon will occur in gait analysis not only because of differences in walking contexts, but simply because people do not behave uniformly even in uniform situations.

The concept "rate of time flow", which is sometimes presented as meaningless, can actually be made quite precise. It simply means measuring time increments with respect to some other sequence of events. In the spacelike model, the measure of the rate of time flow is precisely $$\frac{\Delta t}{\Delta s}.$$

This means that time is measured not by the clock but by how much distance is covered; i.e., purely by the "shape" of the space track. Time gets "warped" because the same distance may be traversed in different amounts of time. However, this effect is completely eliminated by use of spacelike coordinates.

For optics, the scale parameter for spacelike modeling is optical path length. It is this length which is meant when the statement is made that "light takes the shortest path between two points". It is noted that the optical path is by no means straight in $\mathbb{E}^3$: its curvature is governed by the local index of refraction and the frequencies of the incident light.

Spatial time series are almost always presented as absolute positions ($x_i, y_i, z_i$) or increments ($\Delta x_i, \Delta y_i, \Delta z_i$). There are rare experimental situations in which spatial velocities $$\left(\left(\frac{dx}{dt}\right)_i, \left(\frac{dy}{dt}\right)_i, \left(\frac{dz}{dt}\right)_i\right)$$

are directly measured. Remarkably, however, color vision entails the direct measurement of time rates-of-change. Each pixel on a time-varying image such as a video can be seen as a space curve moving through one of the three-dimensional vector space color systems, such as RGB, the C.I.E. XYZ system, television's Y/UV system, and so forth, all of which are linear transformations of one another. Thus, as vector spaces, these systems are just $\mathbf{R}^3$.

The human retina contains four types of light receptors; namely, 3 types of cones, called L,M, and S, and one type of rod. Rods specialize in responding accurately to single photons but saturate at anything above very low light levels. Rod vision is termed "scotopic" and because it is only used for very dim light and cannot distinguish colors, it can be ignored for our purposes. The cones, however, work at any level above low light up to extremely bright light such as the sun on snow. Moreover, it is the cones which distinguish colors. Cone vision is called "photopic" and so the color system presented herein is denoted "photopic coordinates."

Each photoreceptor contains a photon-absorbing chemical called rhodopsin containing a component which photoisomerizes (i.e., changes shape) when it absorbs a photon. The rhodopsins in each of the receptor types have slightly different protein structures causing them to have selective frequency sensitivities.

Essentially, the L cones are the red receptors, the M cones the green receptors, and the S cones the blue receptors, although this is a loose classification. All the cones respond to all visible frequencies. This is especially pronounced in the L/M system whose frequency separation is quite small. Yet it is sufficient to separate red from green and, in fact, the most common type of color-blindness is precisely this red-green type in which the M cones fail to function properly.

It is noted that it is the number of photoisomerizations that matter. These are considerably fewer than the number of photons which reach the cone. Luminous efficiency is concerned with what one does see, not what one might see. It takes about three photoisomerizations to cause the cone to signal and it takes about 50 ms for the rhodopsin molecule to regenerate itself after photon absorption. So, generally, if the photoisomerization rate is anything above 60 photoisomerizations/sec, then the cone's response is continuous and additive. That is, the higher the photoisomerization rate at a given frequency, the larger is the cone's signal to the brain.

So the physiological three-dimensional color system is the LMS system, in which the coordinate values are the total photoisomerization rate of each of the cone types. All the other coordinate systems are implicitly derived from this one.

Since the LMS values are time rates, the homogeneous coordinates corresponding to the color $(L_i,M_i,S_i)$ are $(L_i\cdot\Delta t_i, M_i\cdot\Delta t_i, S_i\cdot\Delta t_i, \Delta t_i)$. It is noted that $L_i\cdot\Delta t_i$ equals the total number of photoisomerizations that occurred during the time interval $t_i$ to $t_i+\Delta t_i$ and similarly for the other coordinates. The homogeneous coordinates (l,m,s,t), where l is the number of photosomerizations of the L-system, m of the M-system, s of the S-system, and t the time, is called photopic coordinates.

Since there are various well-known approximate transformations from the standard RGB or XYZ systems to LMS, the photopic coordinate increments can be calculated:

$$(\Delta l_i,\Delta m_i,\Delta s_i,\Delta t_i)=(L_i\cdot\Delta t_i,M_i\cdot\Delta t_i,S_i\cdot\Delta t_i,\Delta t_i)$$

along pixel color curve specified in any system.

The photopic coordinates (Δl,Δm,Δs,Δt) correspond to what is referred to as timelike coordinates for space curves. There are spacelike versions (Δl,Δm,Δs,Δκ) where Δκ is a photometric length of the photoisomerization interval (Δl, Δm,Δs). However, Δκ is much more complicated to define than the simple Pythagorean length $\sqrt{(\Delta l)^2+(\Delta m)^2+(\Delta s)^2}$.

Applying the Fundamental Theorem Prop. 3 to n=1 implies that any quaternion q can be written in the form $q=u\lambda u^*$ with $u\in\mathbf{U}$ and $\lambda\in\mathbf{C}$. Thus, $q=u(\mathrm{Re}(\lambda)+\mathrm{Im}(\lambda)I)u^*=\mathrm{Re}(\lambda)+\mathrm{Im}(\lambda)(uIu^*)$ so $Sc(q)=\mathrm{Re}(\lambda)$ and Vc(q) is the rotation of $\mathrm{Im}(\lambda)I$ determined by u.

However, by Prop. 4, u is not unique and this can also been seen from the basic geometry because there is not a unique rotation sending $\mathrm{Im}(\lambda)I$ to Vc(q).

However, if $\mathrm{Im}(\lambda)I$ is required to move in the most direct way possible; i.e., along a great circle, then this rotation is unique and defines an external $u\in\mathbf{U}$, unique up to sign. This can be denoted as the polar representation of a quaternion because it is directly related to the representation of Vc(q) in polar coordinates.

Let $q=a+bI+cJ+dK=a+\vec{v}$. λ is an eigenvalue of $$[\![q]\!]=\begin{pmatrix} a+bi & c+di \\ -c+di & a-bi \end{pmatrix}$$

with characteristic polynomial $p(x)=x^2-2ax+|q|^2$ and whose roots are $a\pm vi$, where $v=|\vec{v}|=\sqrt{b^2+c^2+d^2}$ such that $\lambda=a+vi$ is chosen.

Assuming $c^2+d^2\neq 0$, the unit vector $$\hat{\alpha}=\frac{-dJ+cK}{\sqrt{c^2+d^2}}$$

is such that $\hat{\alpha}, I, \vec{v}$ is a right-hand orthogonal system. So $\vec{v}$ is obtained from vI by right-hand rotation around $\hat{\alpha}$ by an angle φ. Clearly $$\cos(\varphi)=\frac{b}{v}$$

if $b^2+c^2+d^2\neq 0$ and $0\leqq\phi\leqq\pi$. Since then $$0\leq\frac{\varphi}{2}\leq\frac{\varphi}{2},$$

$$\cos\left(\frac{\varphi}{2}\right)=\sqrt{\frac{1+\cos(\varphi)}{2}}=\sqrt{\frac{v+b}{2v}}$$

$$\sin\left(\frac{\varphi}{2}\right)=\sqrt{\frac{1-\cos(\varphi)}{2}}=\sqrt{\frac{v-b}{2v}}$$

and therefore $$u=\cos\left(\frac{\varphi}{2}\right)+\sin\left(\frac{\varphi}{2}\right)\hat{\alpha}=\frac{1}{\sqrt{2v}}\left(\sqrt{v+b}+\left(\sqrt{v-b}\right)\hat{\alpha}\right).$$

So long as $\vec{v}\neq\vec{0}$ singularities in this formula can be removed. However, there is an unremovable singularity at $\vec{v}=\vec{0}$ whose behavior is analogous to the unremovable singularity at z=0 of $$\mathrm{sgn}(z)=\frac{z}{|z|}$$

for $z\in\mathbf{C}$.

The present invention, according to one embodiment, represents quaternions in polar form; that is, a quaternion q, representing a three- or four-dimensional data point, is decomposed into the polar form $q=u\lambda u^*$, then the pair $u\in\mathbf{H},\lambda\in\mathbf{C}$ are processed independently.

In particular, it is noted that the eigenvalues $\lambda$ are in the commutative field C so that the simplifications of linear prediction which result from the commutativity, such as Cor.6.ii, apply to these values.

In this way, for example, a discrete spacetime path $(\alpha x_n, \Delta y_n, \Delta z_n, \Delta t_n)$, $n \in \mathbf{Z}$ in $\mathbf{R}^4$ is first transformed into the quaternion path $(\Delta t_n + \Delta x_n I + \Delta y_n J + \Delta z_n K, n \in \mathbf{Z})$ and then into the pair of paths $(u_n \in \mathbf{H}, n \in \mathbf{Z})$ and $(\lambda_n \in \mathbf{C}, n \in \mathbf{Z})$ for which separate linear prediction structures are determined.

These structures may either be combined or treated as separate parameters depending upon the application.

The modules that are of concern for the present invention are derived from measurable functions of the form:

$$\mathbf{T} \times \Omega \xrightarrow{*} X,$$

where X is an A-module with a definite inner product, T is some time parameter space (usually R or Z), and $\Omega$ is a probability space with probability measure P. Thus $\Psi$ is a stochastic process.

However, this definition also includes the deterministic case by setting $\Omega = \{*\}$, the 1-point space, and $P(\emptyset)=0$, $P(\Omega)=1$.

Viewed as a function of the random outcomes $\omega \in \Omega$, $\Psi: \Omega \to X^T$ is regarded as a random path in X; i.e., $\Psi$ induces a probability measure $P_\Psi$ on the set of all paths $\{x(t): \mathbf{T} \to X\}$. In the deterministic case, the image of $\Psi: \Omega \to X^T$ is just the single path $x_*(t) = \Psi(t,*) \in X$ and $P_\Psi$ is concentrated at $$x_*: P_\Psi(E) = \begin{cases} 1, \text{ if } x_* \in E \\ 0, \text{ if } x_* \notin E \end{cases}.$$

On the other hand, viewed as a function of the time parameter $t \in \mathbf{T}$, $\Psi: \mathbf{T} \to X^\Omega$ is regarded as a path of random elements of X: for every $t \in \mathbf{T}$, the value x(t) is an X-valued random variable $\omega \mapsto x(t)(\omega) = \Psi(t,\omega)$. In the deterministic case, $x(t) = x_*(t)$ as defined above.

For example, given a random sample $\omega_1, \ldots, \omega_N \in \Omega$, the resulting sampled paths can be viewed in two ways:

(i) As N randomly chosen paths $x_1, \ldots x_N: \mathbf{T} \to X$, defined by $((\forall t \in \mathbf{T}) x_\nu(t) = \Psi(t, \omega_\nu))$, $\nu = 1, \ldots, N$ (ii) As a single path $x: \mathbf{T} \to X^N$ defined by $((\forall t \in \mathbf{T}) x(t) = \langle \Psi(t,\omega_1), \ldots, \Psi(t,\omega_N) \rangle)$ where, for each $t \in \mathbf{T}$, the list $\langle \Psi(t,\omega_1), \ldots, \Psi(t,\omega_N) \rangle \in X^N$ is viewed as a random sample from X.

A conventional real-valued random signal $s: \mathbf{R} \to \mathbf{R}$ would be viewed as a path through the one-dimensional R-module $X = \mathbf{R}$, with time parameter $t \in \mathbf{R}$.

It is important to note that a signal is really a (random or deterministic) path through some A-module with a definite inner product. The special case of this construction of interest is when the scalars A form a real or complex Banach space. With respect to Banach spaces, it is observed that many measurable functions $f: (\Xi, \mu) \to \mathbf{B}$, where $(\Xi, \mu)$ is a measure space and B is a Banach space, can be integrated $$\int_\Xi f \, d\mu \in B$$

and that this integral possesses the usual properties. When $(\Omega, P)$ is a probability space, this can be interpreted as the average or expected value $$\varepsilon[f] = \int_\Omega f \, dP \in B.$$

For example, the matrix algebras M(n,n,D), D=R,C,H can be shown to be Banach spaces with their standard inner products.

Then any two random paths $$T \times \Omega \xrightarrow{\Psi, \Phi} X$$

define a function $$T \times \Omega \xrightarrow{(\Psi, \Phi)} B:$$

$(t,\omega) \mathbf{C} \langle \Psi(t,\omega), \Phi(t,\omega) \rangle$. In particular, any random path $$T \times \Omega \xrightarrow{\Psi} X$$

defines $\mathbf{T} \times \Omega \xrightarrow{*} B: (t,\omega) \mapsto {}^2|\Psi(t,\omega)|$.

Such functions can be averaged in two different ways: (1) with respect $t \in \mathbf{T}$, and (2) with respect to $\omega \in \Omega$, or vice versa.

From the first perspective, for every $\omega \in \Omega$, the following is formed:

$$\text{value} \lim_{T \to \infty} \frac{1}{2T} \int_T^T {}^2|\Psi(t, \omega)| \, dt \in B$$

$$\left( \text{or} \lim_{N \to \infty} \frac{1}{2N} \sum_{n=-N}^{N} {}^2|\Psi(n, \omega)| \text{ when } T \text{ is discrete} \right)$$

and then the function sending $$\omega \mapsto \lim_{T \to \infty} \frac{1}{2T} \int_T^T {}^2|\Psi(t, \omega)| \, dt \in B$$

is a B-valued random variable on the probability space $(\Omega, P)$. As such, the expected value is formed:

$$\varepsilon\left[ \lim_{T \to \infty} \frac{1}{2T} \int_{-T}^{T} {}^2|\Psi(t, \omega)| \, dt \right] \in B.$$

Alternatively, for every $t \in \mathbf{T}$, the expected value $\epsilon[\Psi(t,\omega)] \epsilon \mathbf{B}$ which, for 0-mean paths, is the variance at $t \epsilon \mathbf{B}$ can first be found, and then averaging these variances to form $$\lim_{T\to\infty} \frac{1}{2T} \int_{-T}^{T} \varepsilon[{}^2|\Psi(t,\omega)|]\, dt \in B.$$

Either of these double integrals may be regarded as the expected total power ${}^2|\Psi|$ of the path and the only assumption that needs to be made concerning the interrelation between the probability and the geometry is that one or the other of these integrals is finite.

When this obtains, it can be shown that the two different methods of calculating this average coincide as in the Fubini Theorem:

$${}^2|\Psi| = \varepsilon\left[\lim_{T\to\infty} \frac{1}{2T} \int_{-T}^{T} {}^2|\Psi(t,\omega)|\, dt\right] = \lim_{T\to\infty} \frac{1}{2T} \int_{-T}^{T} \varepsilon[\Psi(t,\omega)]\, dt.$$

When $$T \times \Omega \xrightarrow{\Psi,\Phi} X$$

are two such paths, then their inner product can be defined as $$\langle \Psi, \Phi \rangle = \lim_{T\to\infty} \frac{1}{2T} \int_{-T}^{T} \varepsilon[\langle \Psi(t,\omega), \Phi(t,\omega) \rangle]\, dt \in B$$

$$\text{and } \langle \Psi, \Phi \rangle = \varepsilon\left[\lim_{T\to\infty} \frac{1}{2T} \int_{-T}^{T} \langle \Psi(t,\omega), \Phi(t,\omega) \rangle\, dt\right].$$

This inner product becomes definite by identifying paths $\Psi,\Phi$ for which ${}^2|\Psi-\Phi|=0$ in the usual manner; i.e., by considering equivalence classes of paths rather than the paths themselves.

The result is a well-defined path space $\mathcal{P}(X,\Omega,P)$ which is a $\mathbf{B}$-module with definite inner product determined by both the geometry of the $\mathbf{B}$-module X and probability space $(\Omega,P)$.

Attention is now drawn to linear prediction on $\mathcal{P}(X,\Omega,P)$. Let $$T \times \Omega \xrightarrow{\Psi} X$$

be a path where $\mathbf{T}$is discrete (or continuous but sampled at time increments $\Delta t_i$), then $\Psi$ defines the sequence $\Psi_0$, $\Psi_1, \ldots, \Psi_M, \ldots \epsilon \mathcal{P}(X,\Omega,P)$ of its past values $$\Psi_m(n,\omega)=\Psi(n-m,\omega).$$

This sequence is toeplitz since $$\begin{aligned}\langle \Psi_k, \Psi_m \rangle &= \lim_{N\to\infty} \frac{1}{2N} \sum_{n=-N}^{N} \varepsilon[\langle \Psi_k(n,\omega), \Psi_m(n,\omega) \rangle] \\ &= \lim_{N\to\infty} \frac{1}{2N} \sum_{n=-N}^{N} \varepsilon[\langle \Psi(n-k,\omega), \Psi(n-m,\omega) \rangle] \\ &= \lim_{N\to\infty} \frac{1}{2N} \sum_{n=-N}^{N} \varepsilon[\langle \Psi(n,\omega), \Psi(n-(m-k),\omega) \rangle]\end{aligned}$$

depends only on the difference m−k.

Thus, the modified Levinson algorithm, as detailed above, can be applied to the toeplitz sequence $\Psi_0$, $\Psi_1, \ldots, \Psi_M, \ldots \epsilon \mathcal{P}(X,\Omega,P)$ to produce the Levinson parameters $$\begin{cases} \Psi_0 = -\sum_{m=1}^{M} a_m^{(M)} \Psi_m + e^{(M)}, \; e^{(M)} \perp \Psi_1, \ldots, \Psi_M \\ \Psi_M = -\sum_{m=0}^{M-1} b_m^{(M)} \Psi_m + f^{(M)}, \; f^{(M)} \perp \Psi_0, \ldots, \Psi_{M-1}, \\ a_1^{(M)}, \ldots, a_M^{(M)}, b_0^{(M)}, \ldots, b_{M-1}^{(M)} \in A, \; e^{(M)}, f^{(M)} \in P(X, \Omega, P) \end{cases}$$

Of course, $\mathcal{P}(X,\Omega,P)$ is usually infinite-dimensional. However, when A is hermitian regular, as with M(n,n,D), D=$\mathbf{R}$,$\mathbf{C}$,$\mathbf{H}$, the Levinson algorithm applies without any changes.

Figure 5:
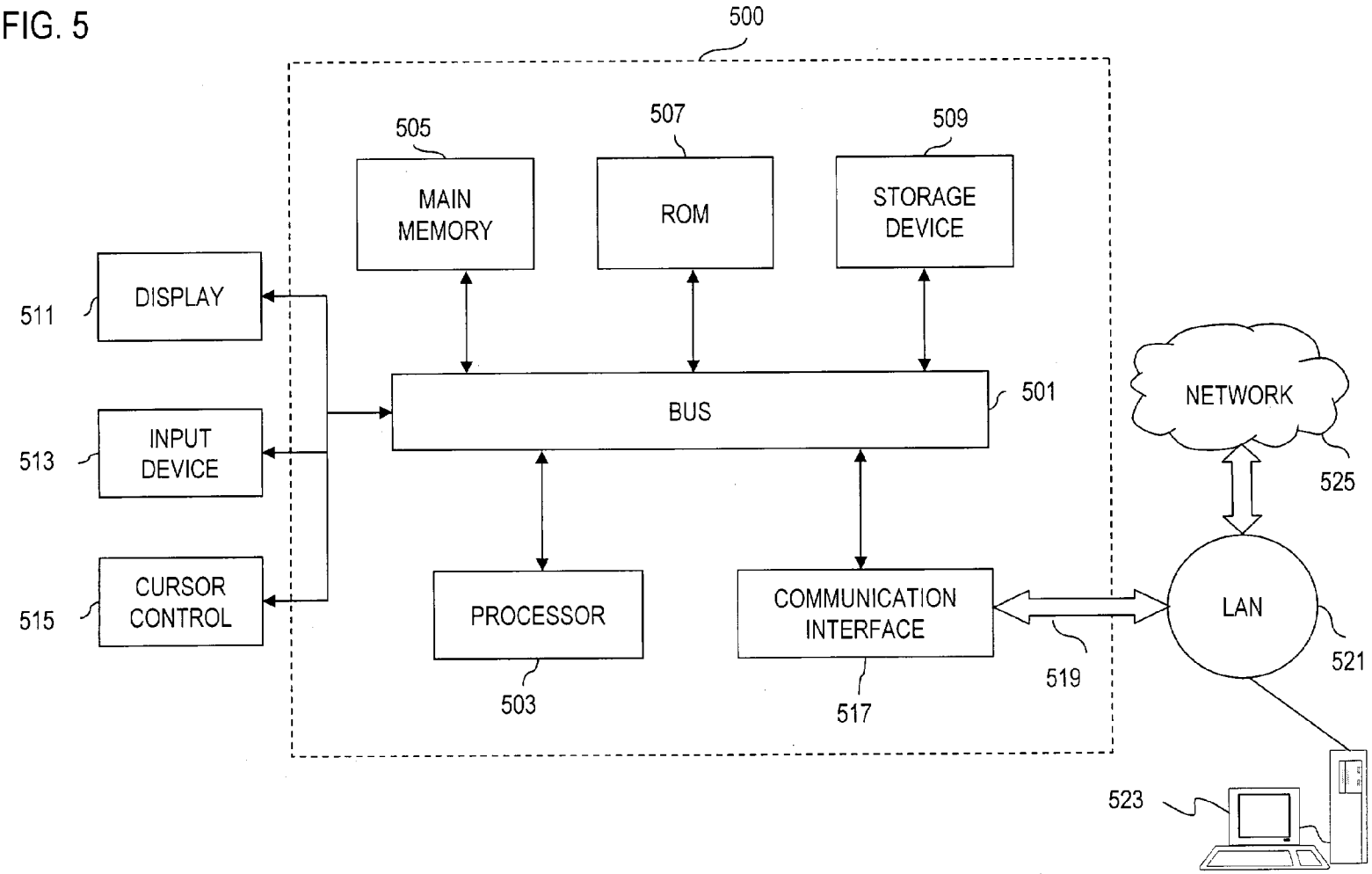
FIG. 5 is a diagram of a computer system that can be used to implement an embodiment of the present invention.

The modified Levinson algorithm can be computed using any computing system, as that described in FIG. 5.

FIG. 5 illustrates a computer system 500 upon which an embodiment according to the present invention can be implemented. The computer system 500 includes a bus 501 or other communication mechanism for communicating information and a processor 503 coupled to the bus 501 for processing information. The computer system 500 also includes main memory 505, such as a random access memory (RAM) or other dynamic storage device, coupled to the bus 501 for storing information and instructions to be executed by the processor 503. Main memory 505 can also be used for storing temporary variables or other intermediate information during execution of instructions by the processor 503. The computer system 500 may further include a read only memory (ROM) 507 or other static storage device coupled to the bus 501 for storing static information and instructions for the processor 503. A storage device 509, such as a magnetic disk or optical disk, is coupled to the bus 501 for persistently storing information and instructions.

The computer system 500 may be coupled via the bus 501 to a display 511, such as a cathode ray tube (CRT), liquid crystal display, active matrix display, or plasma display, for displaying information to a computer user. An input device 513, such as a keyboard including alphanumeric and other keys, is coupled to the bus 501 for communicating information and command selections to the processor 503. Another type of user input device is a cursor control 515, such as a mouse, a trackball, or cursor direction keys, for communicating direction information and command selections to the processor 503 and for controlling cursor movement on the display 511.

According to one embodiment of the invention, the process of FIG. 3 is provided by the computer system 500 in response to the processor 503 executing an arrangement of instructions contained in main memory 505. Such instructions can be read into main memory 505 from another computer-readable medium, such as the storage device 509. Execution of the arrangement of instructions contained in main memory 505 causes the processor 503 to perform the process steps described herein. One or more processors in a multi-processing arrangement may also be employed to execute the instructions contained in main memory 505. In alternative embodiments, hard-wired circuitry may be used in place of or in combination with software instructions to implement the embodiment of the present invention. Thus, embodiments of the present invention are not limited to any specific combination of hardware circuitry and software.

The computer system 500 also includes a communication interface 517 coupled to bus 501. The communication interface 517 provides a two-way data communication coupling to a network link 519 connected to a local network 521. For example, the communication interface 517 may be a digital subscriber line (DSL) card or modem, an integrated services digital network (ISDN) card, a cable modem, a telephone modem, or any other communication interface to provide a data communication connection to a corresponding type of communication line. As another example, communication interface 517 may be a local area network (LAN) card (e.g. for Ethernet™ or an Asynchronous Transfer Model (ATM) network) to provide a data communication connection to a compatible LAN. Wireless links can also be implemented. In any such implementation, communication interface 517 sends and receives electrical, electromagnetic, or optical signals that carry digital data streams representing various types of information. Further, the communication interface 517 can include peripheral interface devices, such as a Universal Serial Bus (USB) interface, a PCMCIA (Personal Computer Memory Card International Association) interface, etc. Although a single communication interface 517 is depicted in FIG. 5, multiple communication interfaces can also be employed.

The network link 519 typically provides data communication through one or more networks to other data devices. For example, the network link 519 may provide a connection through local network 521 to a host computer 523, which has connectivity to a network 525 (e.g. a wide area network (WAN) or the global packet data communication network now commonly referred to as the "Internet") or to data equipment operated by a service provider. The local network 521 and network 525 both use electrical, electromagnetic, or optical signals to convey information and instructions. The signals through the various networks and the signals on network link 519 and through communication interface 517, which communicate digital data with computer system 500, are exemplary forms of carrier waves bearing the information and instructions.

The computer system 500 can send messages and receive data, including program code, through the network(s), network link 519, and communication interface 517. In the Internet example, a server (not shown) might transmit requested code belonging an application program for implementing an embodiment of the present invention through the network 525, local network 521 and communication interface 517. The processor 503 may execute the transmitted code while being received and/or store the code in storage device 59, or other non-volatile storage for later execution. In this manner, computer system 500 may obtain application code in the form of a carrier wave.

The term "computer-readable medium" as used herein refers to any medium that participates in providing instructions to the processor 505 for execution. Such a medium may take many forms, including but not limited to non-volatile media, volatile media, and transmission media. Non-volatile media include, for example, optical or magnetic disks, such as storage device 509. Volatile media include dynamic memory, such as main memory 505. Transmission media include coaxial cables, copper wire and fiber optics, including the wires that comprise bus 501. Transmission media can also take the form of acoustic, optical, or electromagnetic waves, such as those generated during radio frequency (RF) and infrared (IR) data communications. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, and EPROM, a FLASH-EPROM, any other memory chip or cartridge, a carrier wave, or any other medium from which a computer can read.

Various forms of computer-readable media may be involved in providing instructions to a processor for execution. For example, the instructions for carrying out at least part of the present invention may initially be borne on a magnetic disk of a remote computer. In such a scenario, the remote computer loads the instructions into main memory and sends the instructions over a telephone line using a modem. A modem of a local computer system receives the data on the telephone line and uses an infrared transmitter to convert the data to an infrared signal and transmit the infrared signal to a portable computing device, such as a personal digital assistant (PDA) or a laptop. An infrared detector on the portable computing device receives the information and instructions borne by the infrared signal and places the data on a bus. The bus conveys the data to main memory, from which a processor retrieves and executes the instructions. The instructions received by main memory can optionally be stored on storage device either before or after execution by processor.

Accordingly, the present invention provides an approach for performing signal processing. Multi-dimensional data (e.g., three- and four-dimensional data) can be represented as quaternions. These quaternions can be employed in conjunction with a linear predictive coding scheme that handles autocorrelation matrices that are not invertible and in which the underlying arithmetic is not commutative. The above approach advantageously avoids the time-warping and extends linear prediction techniques to a wide class of signal sources.

While the present invention has been described in connection with a number of embodiments and implementations, the present invention is not so limited but covers various obvious modifications and equivalent arrangements, which fall within the purview of the appended claims.

What is claimed is:

1. A method for providing linear prediction, the method comprising:

collecting multi-channel data from a plurality of independent sources;

representing the multi-channel data as vectors of quaternions;

generating an autocorrelation matrix corresponding to the quaternions; and outputting linear prediction coefficients based upon the autocorrelation matrix, wherein the linear prediction coefficients represent a compression of the collected multi-channel data.

2. A method according to claim 1, wherein the data in the representing step includes at least one of 3-dimensional data and 4-dimensional data.

3. A method according to claim 1, wherein the multi-channel data represents one of video signals, and voice signals.

4. A method for supporting video compression, the method comprising:

collecting time series video signals as multi-channel data, wherein the multi-channel data is represented as vectors of quaternions;

generating an autocorrelation matrix corresponding to the quaternions; and outputting linear prediction coefficients based upon the autocorrelation matrix.

5. A method according to claim 4, further comprising:

transmitting the linear prediction coefficients over a data network to a remote video display for displaying images represented by the video signals that are generated from the transmitted linear prediction coefficients.

6. A method of signal processing, the method comprising:

receiving multi-channel data;

representing multi-channel data as vectors of quaternions; and performing linear prediction based on the quaternions.

7. A method according to claim 6, further comprising:

outputting an autocorrelation matrix corresponding to the quaternions, wherein the linear prediction is performed based on the autocorrelation matrix.

8. A method according to claim 6, wherein the data in the representing step includes at least one of 3-dimensional data and 4-dimensional data.

9. A method according to claim 6, wherein the multi-channel data represents one of video signals, and voice signals.

10. A method of performing linear prediction, the method comprising:

representing multi-channel data as a pseudo-invertible matrix;

generating a pseudo-inverse of the matrix; and outputting a plurality of linear prediction weight values and associated residual values based on the generating step.

11. A method according to claim 10, wherein the multi-channel data is represented as a vector of quaternions.

12. A method according to claim 10, further comprising:

computing Levinson parameters corresponding to the matrix, wherein the plurality of linear prediction weight values and associated residual values is based on the computed Levinson parameters.

13. A method according to claim 10, wherein the matrix has scalars that are non-commutative.

14. A method according to claim 10, wherein the multi-channel data is represented as elements of a random path module.

15. A computer-readable medium carrying one or more sequences of one or more instructions for performing signal processing, the one or more sequences of one or more instructions including instructions which, when executed by one or more processors, cause the one or more processors to perform the steps of:

receiving multi-channel data;

representing multi-channel data as vectors of quaternions; and performing linear prediction based on the quaternions.

16. A computer-readable medium according to claim 15, wherein the one or more processors further perform the step of:

outputting an autocorrelation matrix corresponding to the quaternions, wherein the linear prediction is performed based on the autocorrelation matrix.

17. A computer-readable medium according to claim 15, wherein the data in the representing step includes at least one of 3-dimensional data and 4-dimensional data.

18. A computer-readable medium according to claim 15, wherein the multi-channel data represents one of video signals, and voice signals.

19. A computer-readable medium carrying one or more sequences of one or more instructions for performing linear prediction, the one or more sequences of one or more instructions including instructions which, when executed by one or more processors, cause the one or more processors to perform the steps of:

representing multi-channel data as a pseudo-invertible matrix;

generating a pseudo-inverse of the matrix; and outputting a plurality of linear prediction weight values and associated residual values based on the generating step.

20. A computer-readable medium according to claim 19, wherein the multi-channel data is represented as a vector of quaternions.

21. A computer-readable medium according to claim 19, wherein the one or more processors further perform the step of:

computing Levinson parameters corresponding to the matrix, wherein the plurality of linear prediction weight values and associated residual values is based on the computed Levinson parameters.

22. A computer-readable medium according to claim 19, wherein the matrix has scalars that are non-commutative.

23. A computer-readable medium according to claim 19, wherein the multi-channel data is represented as elements of a random path module.

* * * * *